US006029638A

United States Patent [19]

Funai et al.

[11] Patent Number: 6,029,638

[45] Date of Patent: Feb. 29, 2000

[54] INTERNAL COMBUSTION ENGINE WITH DRY SUMP LUBRICATING SYSTEM

[75] Inventors: Hiroshi Funai; Hideo Shigedomi; Yasushi Fujita, all of Wako, Japan

[73] Assignee: Honda Giken Kogyo Kabushiki Kaisha, Japan

[21] Appl. No.: 09/187,127

[22] Filed: Nov. 5, 1998

[30] Foreign Application Priority Data

| | | | |
|---|---|---|---|
| Nov. 7, 1997 | [JP] | Japan | 9-306222 |
| Nov. 19, 1997 | [JP] | Japan | 9-318296 |
| Nov. 19, 1997 | [JP] | Japan | 9-318311 |

[51] Int. Cl.[7] ..... F02B 77/00; F01M 1/02; F01M 11/00; B63B 35/00

[52] U.S. Cl. ..... 123/572

[58] Field of Search ..... 123/572, 573, 123/574, 41.86

[56] References Cited

U.S. PATENT DOCUMENTS

| | | | |
|---|---|---|---|
| 4,601,267 | 7/1986 | Kronich | 123/572 |
| 4,721,090 | 1/1988 | Kato | 123/572 |
| 4,856,486 | 8/1989 | Mori et al. | 123/572 |

FOREIGN PATENT DOCUMENTS

| | | |
|---|---|---|
| 60-8109 | 3/1985 | Japan . |
| 62-23514 | 1/1987 | Japan . |
| 3-9027 | 1/1991 | Japan . |

*Primary Examiner*—Marguerite McMahon
*Attorney, Agent, or Firm*—Adams & Wilks

[57] ABSTRACT

An internal combustion engine with dry sump lubricating system includes a feed pump which supplies lubricating oil from a lubricating oil tank disposed outside an engine body to all moving parts in the engine. After circulating through the engine, the lubricating oil drops down into a crank chamber and is immediately picked up from the crank chamber and sent back into the lubricating oil tank by a recovery pump. Since the lubricating oil tank is attached to an end of the engine body from which a crankshaft project, it does not increase the overall width (dimension in the direction perpendicular to the axis of the crankshaft) and height of the engine. Even when the engine has inclined cylinders, the lubricating oil tank can avail a high degree of design freedom because the end face is not influenced by inclination of the cylinders as greatly as side surfaces of the engine body. The engine also includes a breather system so designed as to prevent an operation failure of the engine which would otherwise be caused due to inflow of the lubricating oil into an intake system of the engine.

15 Claims, 16 Drawing Sheets

INTERNAL COMBUSTION ENGINE WITH DRY SUMP LUBRICATING SYSTEM

BACKGROUND OF THE INVENTION

1. Field of the Invention

The present invention relates generally to an engine, and more particularly to improvements in an internal combustion engine with dry sump lubricating system.

2. Description of the Related Art

Internal combustion engines with dry sump lubricating system are known in which a feed pump supplies lubricating oil from a lubricating oil tank disposed outside an engine body to all moving parts in the engine, and the oil which had dropped down into a crank chamber after circulating through the engine is immediately picked up from the crank chamber and sent back into the lubricating oil tank by means of a return pump.

One example of such engines is disclosed in Japanese Patent Laid-open Publication No. SHO 62-23514, which includes a generally L-shaped lubricating oil tank attached to one side of an engine body extending in the longitudinal direction of a crankshaft, and a single feed pump and two return pumps all driven by rotation of the crankshaft and disposed in a space defined between the engine body and the L-shaped lubricating oil tank. The feed pump has an oil pickup tube extending into the lubricating oil tank and picks lubricating oil up from the lubricating oil tank through the oil pickup tube and supplies the lubricating oil through oil passages to moving parts in the engine. After circulating through the engine, the lubricating oil drops down into a crank chamber and is collected into a pair of parallel oil sumps extending in a bottom surface of the crank chamber in a longitudinal direction of the crankshaft. Each of the return pumps sends the lubricating oil from a corresponding one of the oil sumps back into the lubricating oil tank through one recovery passage. Baffle plates are provided above the oil sump so that the lubricating oil in the oil sump is prevented from splashing over the crankshaft. A breather device is provided at an upper end of the lubricating oil tank to interconnect an internal space of the lubricating oil tank and an intake device of the engine for circulating oil vapors into an intake system of the engine.

The disclosed engine has the advantage of having oil passages of reduced lengths, however, it still has a drawback that the lubricating oil tank attached to the side of the engine body increases the engine width (i.e., extent of the engine in a transverse direction of the crankshaft), posing a great spatial limitation when the engine is installed in a motor vehicle or a small boat. Additionally, since the baffle plates are each comprised of a single press-formed rectangular plate extending over and along the entire length of the oil sump, production of such baffle plates requires use of a press-forming mold assembly which is relatively large in size and expensive to manufacture and hence increases the manufacturing cost of the engine. Furthermore, when the engine is greatly inclined from the vertical or turned upside down, the breather device provided at the upper end of the lubricating oil tank may allow the lubricating oil to flow out from the lubricating oil tank and then enter the intake system of the engine. Inflowing of the lubricating oil may deteriorate the engine performance and sometimes cause a malfunction of the engine. The known engine is, therefore, not suitable for use in a small boat such as a closed lifeboat which while in use is subjected to great changes in posture including overturn or capsize.

Another example of the known engines with dry sump lubricating system is disclosed in Japanese Patent Laid-open Publication No. HEI 3-9027. The disclosed engine is an automotive engine and includes a lubricating oil tank secured to a bottom wall of the crankcase of an engine body, a supply pump and two return pumps, all the pumps being driven by a power take-out shaft extending parallel to a crankshaft. The feed pump picks up lubricating oil from the lubricating oil tank using an oil pickup tube extending into the lubricating oil tank and supplies the lubricating oil to moving parts in the engine. After circulating through the engine, the lubricating oil drops down into the crankcase and gathers into an elongated groove-like oil sump extending in the bottom surface of a crank chamber in the longitudinal direction of the crankshaft. Each of the return pumps returns the lubricating oil from the oil sump to the lubricating oil tank through a recovery passage connected to each end of the oil sump. A breather device is built in an upper portion of the lubricating oil tank. The lubricating oil tank faces in the forward direction of the motor vehicle to provide an improved cooling efficiency of the lubricating oil held in the lubricating oil tank. To this end, the crankshaft is arranged in a transverse direction of the vehicle, cylinders are inclined from the vertical toward the backward direction of the vehicle, and the power take-out shaft is disposed in a diagonal upward position of the crankshaft such that an acute angle is defied between a plane extending between an axis of the power take-out shaft and an axis of the crankshaft and a plane in which axes of the cylinders lie.

Since the engine body and the lubricating oil tank are inclined in opposite directions with respect to the axis of the crankshaft, the overall height of the known engine is relatively small. The known engine, however, has a large width (an extent of the engine in the transverse direction of the crankshaft) which may pose a great spatial limitation when the engine is installed in the vehicle. Another drawback is that when the engine is subjected to a great change in posture such as overturn, the lubricating oil may flow out from the lubricating oil tank through the breather device and then enter an intake system of the engine. The lubricating oil thus introduced may deteriorate engine performance and sometimes cause a malfunction of the engine. The known engine is not suitable for use in a small boat such as a closed lifeboat which, in use, is subjected to great changes in posture including overturn.

An engine suitable for use in a small boat such as a closed lifeboat involving great changes in posture during use is disclosed in Japanese Utility Model Publication No. SHO 60-8109. The disclosed engine has a lubricating system which includes an oil tank provided separately from an oil pan of the engine for receiving therein lubricating oil from the oil pan when the engine is rolled from the upright position through an angle of more than 45 degrees, an oil pipe branched from an oil passage at the engine side and projecting into the oil tank, and a valve assembled in the oil pipe and adapted to open when the engine rolling angle is more than 40 degrees. A breather device of the engine includes a mist separating chamber which communicates with a crank chamber of the engine through a breather of an engine body and a breather pipe. The mist separating chamber is disposed adjacent the oil tank and communicates with the oil tank through a small opening or orifice. A mist pipe, which is connected by a connecting pipe to an intake manifold, projects into the mist separating chamber.

When the rolling angle of the engine is smaller than 45 degrees, a lubricating pump driven by the engine sends the lubricating oil from the oil pan to a main gallery through a branched portion of the oil passage. In this instance, since the valve is in the closed position, the oil pipe does not function as an oil pickup pipe of the lubricating pump. Accordingly, after circulating through the engine, the lubricating oil drops back down into the oil pan.

When the engine rolling angle exceeds 45 degrees, the lubricating oil in the oil pan flows by gravity down into the oil tank through the breather of engine body and the breather pipe. In this instance, the valve assembled in the oil pipe is opened to thereby enable the oil pipe to function as an oil pickup pipe of the pump. As a result, the lubricating oil is picked up from the oil tank through the oil pipe and supplied to the engine side. Since the oil tank and the mist separating chamber communicate with each other through the orifice, a small amount of lubricating oil may flow from the oil tank through the orifice into the mist separating chamber depending on the rolling angle of the engine. However, due to an inlet of the mist pipe being disposed so as not to be flooded with the lubricating oil coming into the mist separating chamber, the lubricating oil is prevented from flowing into the intake manifold through the mist pipe and the connecting pipe.

Although the conventional engine lubricating system has an oil tank provided separately from the crank chamber, it does not belong to the dry sump lubricating system due to the presence of the oil pan of a size which must be large enough to hold substantially all the lubricating oil being used. The large oil pan increases the overall height of the engine. Additionally, since the lubricating oil is caused to flow by gravity down into the oil tank when the engine rolling angle exceeds 45 degrees, the oil tank should preferably be disposed above the upper end of a head cover to secure more recovery of the lubricating oil in the oil tank particularly when the engine is turned upside down. Thus, no reduction in height of the conventional engine is expected.

SUMMARY OF THE INVENTION

It is accordingly an object of the present invention to provide an internal combustion engine with a dry sump lubricating system which is relatively small in size and can increase the degree of freedom in installation of the engine without incurring any increase in the engine size.

Another object of the present invention is to provide an internal combustion engine with a dry sump lubricating system, which is relatively simple in construction and can be manufactured easily at a relatively low cost.

A further object of the present invention is to provide an internal combustion engine with dry sump lubricating system which includes a breather system so constructed as to prevent lubricating oil from flowing into an intake system of the engine even when the engine is caused to roll or overturned.

According to the present invention, there is provided an internal combustion engine having an intake system, comprising: (a) an engine body including a crankshaft rotatably mounted therein with one end projecting from an end face of the engine body, a head cover at the top of the engine body and defining a valve chamber, and a crankcase at the bottom of the engine body and defining a crank chamber; (b) a dry sump lubricating system for lubricating moving parts in the engine with a lubricating oil, the lubricating system including (i) an oil sump at the bottom of the crank chamber for temporarily holding therein the lubricating oil that has dripped from the moving parts down into the crank chamber, (ii) a lubricating oil tank attached to the end face of the engine body for holding therein the lubricating oil, (iii) a feed pump driven by the crankshaft for supplying the lubricating oil from the lubricating oil tank to the moving parts of the engine body, and (iv) a recovery pump driven by the crankshaft for sending the lubricating oil from the oil sump back into the lubricating oil tank; and (c) a breather system connecting the crank chamber and the lubricating oil tank to the intake system of the engine to circulate blowby gas and oil vapors from the crank chamber and the lubricating oil tank to the intake system.

With this construction, the lubricating oil tank attached to the end face of the engine body does not increase the overall width (dimension in the direction perpendicular to the axis of the crankshaft) and height of the engine. Even when the engine is of the type having inclined cylinders, the lubricating oil tank can avail a high degree of design freedom because the end face is not influenced by the inclined cylinders as greatly as side surfaces of the engine body.

In a preferred form of the invention, the lubricating oil tank is disposed below the head cover, and the valve chamber has a first opening and a second opening disposed below the first opening. The breather system includes a breather passage extending between the crank chamber and the valve chamber to connect them in fluid communication with each other, a first breather tube extending between the lubricating oil tank and the first opening of the valve chamber to connect the lubricating oil tank and the valve chamber in fluid communication with each other, a first breather chamber disposed below an upper end of the head cover for separating liquid oil from the blowby gas and oil vapors, the first breather chamber being in fluid communication with the valve chamber via the second opening of the valve chamber, a second breather chamber disposed below the first breather chamber for further separating liquid oil from the blowby gas and oil vapors, a second breather tube extending between the first breather chamber and the second breather chamber to connect them in fluid communication with each other, and a third breather tube extending between the second breather chamber and the intake system of the engine.

When the engine is in the normal posture, the lubricating oil is stored in the lubricating oil tank. When the engine is subjected to a postural change such as rolling through an angle of 180 degrees, the lubricating oil in the lubricating oil tank flows through the first breather tube into the valve chamber. In this instance, due to a vacuum formed in the lubricating oil tank with the feed and recovery pumps being stopped, only a limited quantity of lubricating oil can flow into the valve chamber. In other words, the principle of "Torricellian vacuum" is applied to a passage formed jointly by the lubricating oil tank and the first breather tube. Additionally, the second opening is located below the first opening, the lubricating oil can never flow through the second opening into the first breather chamber and thence into the intake system of the engine. Even when the engine is subjected to postural changes, a sufficient amount of lubricating oil can be recovered from the breather system into the crank chamber. The engine having such breather system is suitable for use in a small boat such as a lifeboat which in use is subjected to frequent postural changes.

The first and second breather chambers are preferably disposed between the upper end of the head cover and a lower end of the crankcase, and so they do not increase the overall height of the engine.

The head cover has a portion projecting in the valve chamber and defining the first breather chamber, and the lubricating oil tank has an upper portion defining the second breather chamber. The second breathing chamber has at least two partition walls having respective orifices offset from one another to define within the second breather chamber at least three breather compartments connected together via the orifices, one of two endmost breather compartments of the three breather compartments is connected to one end of the second breather tube, and the other of the two endmost breather compartments is connected to one end of the third breather tube.

It is preferable that the recovery pump is built in the lubricating oil tank, and the supply pump is connected in driven relation to a camshaft of the engine which is driven by the crankshaft. The engine body further includes a power transmitting mechanism for transmitting rotational power of the crankshaft to the recovery pump to drive the recovery pump. The end face of the engine body has a recessed portion extending around the crankshaft and receiving therein the power transmitting mechanism, the recessed portion being substantially closed by the lubricating oil tank.

The lubricating oil tank includes a tank body attached to the end face of the engine body and having an open end facing in a direction perpendicularly to and away from the end face of the engine body, and an end cover attached to the tank body so as to close the open end of the tank body. By removing the end cover, the interior of the tank body can be easily inspected.

The end face of the engine body is perpendicular to an axis of the crankshaft. The tank body has a first packing surface at an end opposite from the open end and a second packing surface at the open end, the first packing surface being in sealing contact with the end face of the engine body, and the second packing surface being parallel to the first packing surface. The end cover has a cover packing surface being sealing contact with the second packing surface of the tack body. The recovery pump is built in the lubricating oil tank, and at least one of the second packing surface and the cover packing surface has a first oil passage extending between the crank chamber and the recovery pump and a second oil passage extending from the recovery pump and opening to an internal space of the lubricating oil tank. The lubricating system having the recovery pump built in the lubricating oil tank is relatively simple in construction and small in size and can be manufactured at a low cost.

The lubricating oil tank preferably has a bulged portion extending along a side of the engine body in a direction toward an opposite end of the crankshaft. The bulged portion has a lower portion tapering toward a lower end of the lubricating oil tank. In the case where the engine body includes at least one cylinder having an axis inclined from a vertical plane in one direction, the side of the engine body along which the bulged portion of the lubricating oil tank extends is located on a side of the vertical plane which is opposite to the direction of inclination of the axis of the cylinder.

The crankcase includes at least three bearing portions disposed at the bottom of the crank chamber and spaced at predetermined intervals in a longitudinal direction of the crankshaft for rotatably supporting the crankshaft. The oil sump of the lubricating system includes at least two oil sump portions defined between respective adjacent pairs of the bearing portions. The lubricating system further includes at least two press-formed baffle plates of identical configuration attached to the crankcase so as to substantially close the oil sump portions to prevent the lubricating oil from splashing over the crankshaft. The press-formed baffle plate pieces are smaller in size than a conventional press-formed elongated baffle plate and hence can be manufactured by a smaller press-forming mold than the conventional baffle plate. This is contributive to the reduction of manufacturing cost of the engine. In the case where the engine body has at least two cylinders having axes inclined from a vertical plane in one direction, the lubricating system further has a guide passage extending at the bottom of the crank chamber in a longitudinal direction of the crankshaft and connecting the oil sump portions at one end. The guide passage being connected in fluid communication with the recovery pump and located on a side of the vertical plane which is the same as the direction of inclination of the axes of the cylinders.

The above and other objects, features and advantages of the present invention will become apparent to those versed in the art upon making reference to the following description and accompanying sheets of drawings in which certain preferred structural embodiments of the present invention are described by way of illustrative examples.

DETAILED DESCRIPTION OF THE PREFERRED EMBODIMENTS

Certain preferred embodiments of the present invention will be described in greater detail with reference to the accompanying drawings.

Figure 1:
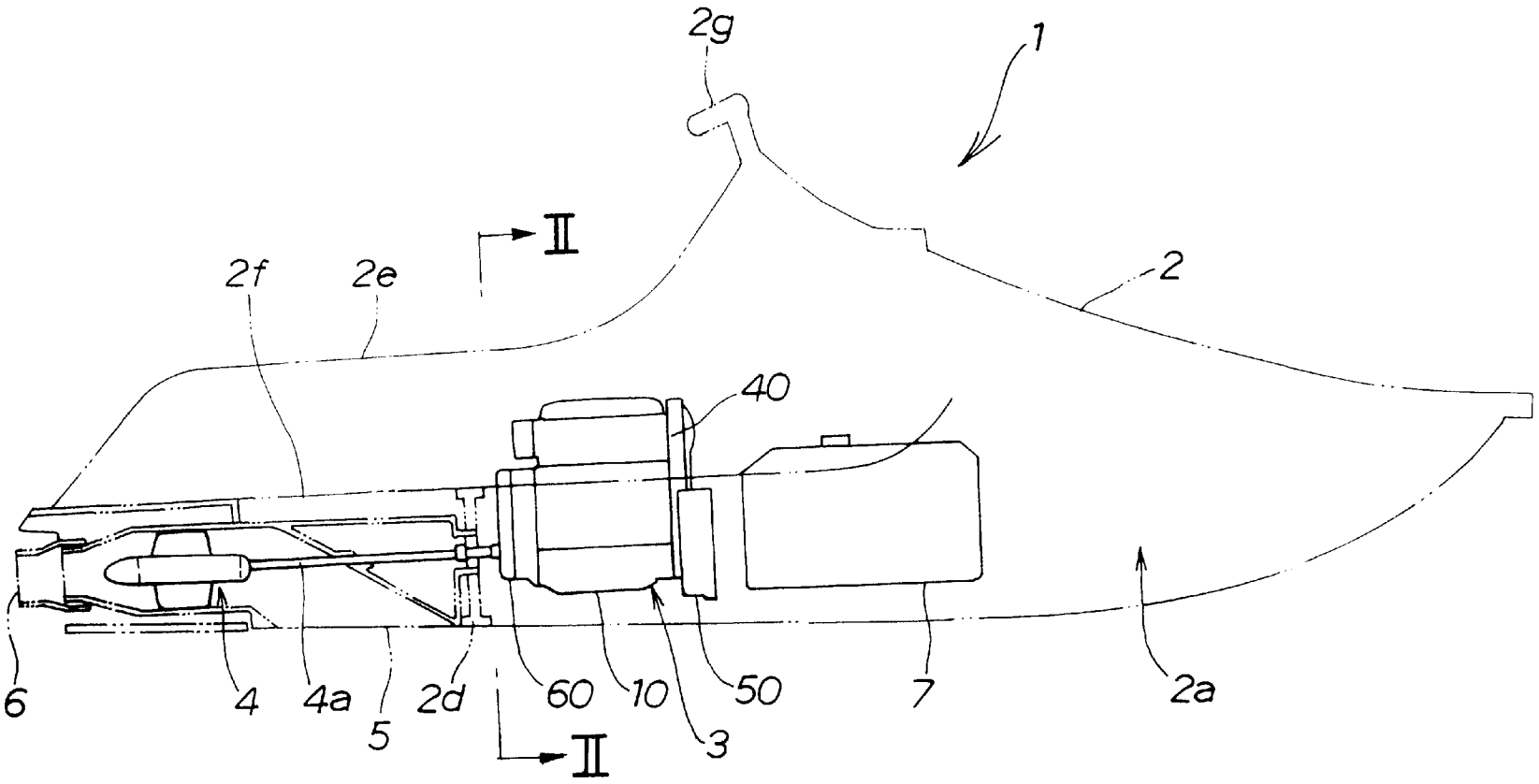
FIG. 1 is a diagrammatical side view of a small pleasure boat in which a four-stroke-cycle internal combustion engine with dray sump lubricating system according to a first embodiment of the present invention is installed.

Referring now to FIG. 1, there is shown in side elevation a small boat 1 equipped with a four-cycle-stroke engine unit 3 having a dry sump lubricating system according to the present invention. The small boat 1 illustrated by phantom lines is used for marine sports, life-saving, etc. and includes an engine room 2*a* in which the engine unit 3 is installed. The engine unit 3 is designed to drive a jet pump 4 in such a way that the jet pump 4 picks up water from a bottom portion of a hull 2, compresses the water and discharges the compressed water in the form of a water jet ejected in the backward direction of the boat to propel the boat. In FIG. 1, reference character 2*d* denotes a bulkhead of the boat; 2*b*, a seat; 2*f*, a deck; 2*g*, a steering bar; 5, a water inlet; 7, a exhaust nozzle; and 7, a fuel tank.

Figure 2:
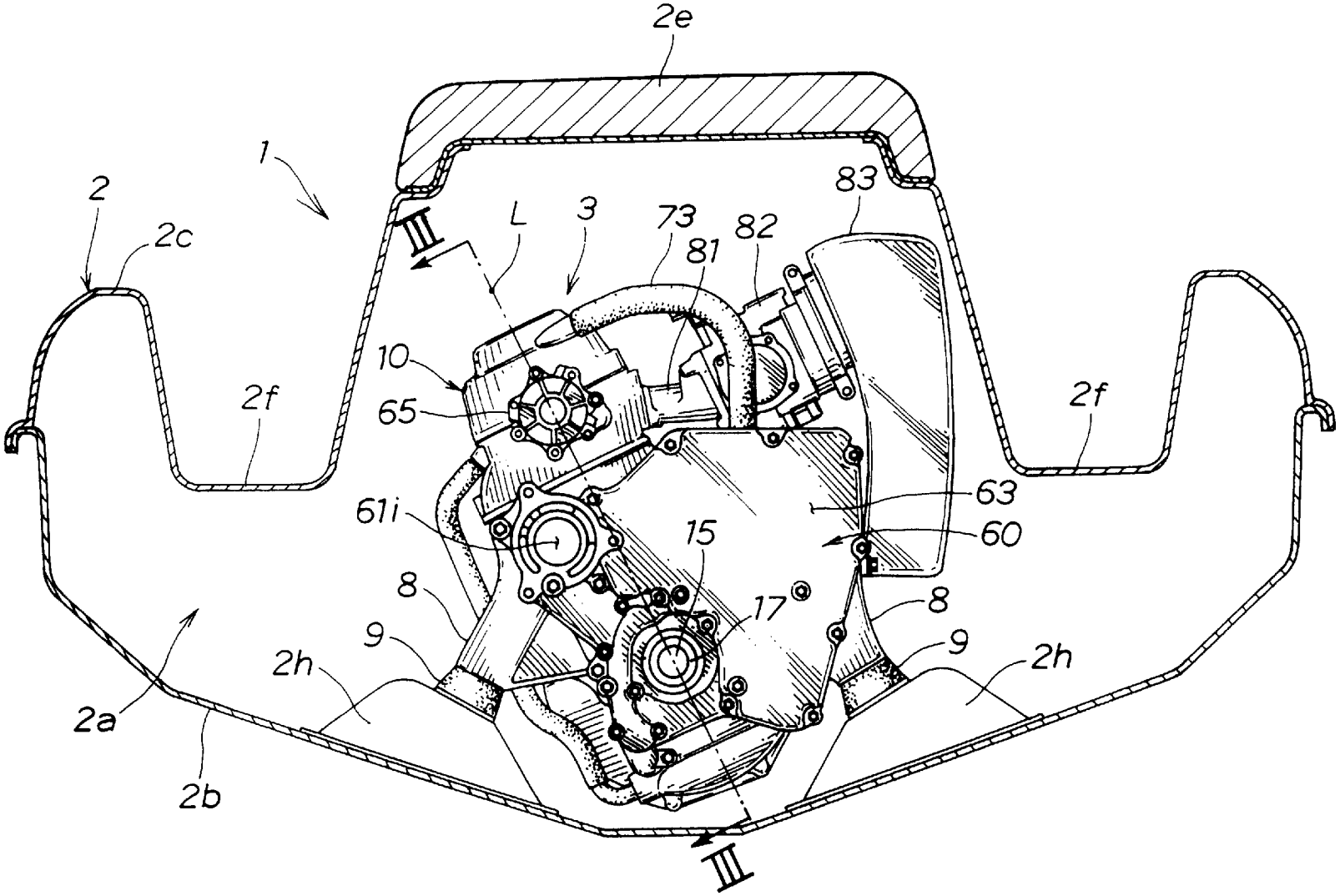
FIG. 2 is a cross-sectional view taken along line II—II of FIG. 1.

As shown in FIG. 2, the engine room 2*a* in which the engine unit 3 is installed is defined between a lower hull 2*b* and an upper hull 2*c*. The engine unit 3 is placed horizontally with a crankshaft 15 extending in the longitudinal direction of the boat 1. The engine unit 3 has a cylinder axis L (axis of each cylinder) inclined in one direction (leftward in FIG. 2) from the vertical and is mounted on the lower hull 2*a* of the boat 1 with one mount rubber 9 disposed between each of four mounts 8 (two being shown) of the engine unit 3 and a corresponding one of four mount bases 2*h* (two being shown) of the lower hull 2*a*.

Figure 3:
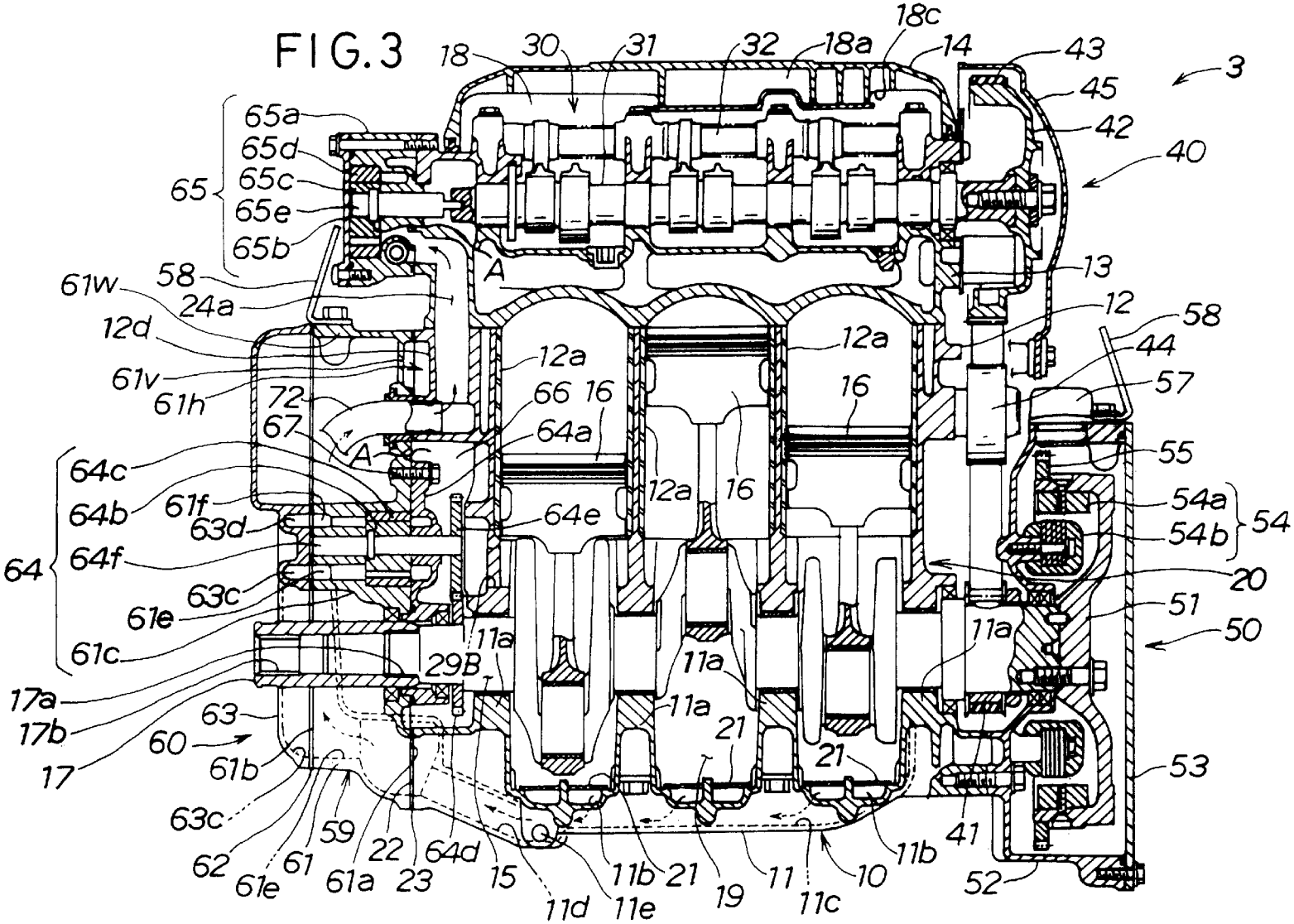
FIG. 3 is a cross-sectional view taken along line III—III of FIG. 2.

FIG. 3 is a cross section taken along line III—III of FIG. 2, showing structural details of the engine unit 3. In this figure, a portion of the engine unit which is located near an oil pickup tube 72 and an intake passage 24*a* is shown, for illustrative purposes, as being laid on the section line III—III of FIG. 2, but actually this engine portion is offset from the section line III—III.

As shown in FIG. 3, the engine unit 3 is a three-cylinder four-stroke-cycle engine and has an output side facing backwards (leftwards in FIG. 3) of the boat 1. The engine unit 3 includes an engine body 10, a valve drive mechanism 40 and a flywheel unit 50 both mounted to the front side of the engine body 10 which is opposite to the output side, and a lubricating unit 60 mounted to the output side of the engine body 10.

The engine body 10 generally comprises a removable crankcase lower half 11, a cylinder block 12 having three cylinders 12*a* in-lined along the longitudinal direction of the engine unit 3, a cylinder head 13 covering and enclosing the cylinders 12*a*, a head cover (valve cover) 14 attached to the cylinder head 13, the aforesaid crankshaft 15 disposed horizontally, three pistons 16 connected in driving relation to the crankshaft 15 and each inserted in a corresponding one of the cylinders 12*a*, a power takeout shaft 17 connected to one end (rear end) of the crankshaft 15, a valve chamber 18 defined between the cylinder head 13 and the head cover 14, and a valve mechanism 30 disposed in the valve chamber 18.

The crankcase lower half 11 and a bottom portion of the cylinder block 12 jointly define a crank chamber 19. Thus, the bottom portion of the cylinder block 12 forms an upper half of the crankcase. The engine body 1 has the valve chamber 18 at the top and the crank chamber 19 at the bottom.

The head cover 14 has a portion projecting in an internal space of the head cover 14 so as to define a first breather chamber 18*a* located at an upper portion of the valve chamber 18. The first breather chamber 18*a* functions to separate oil mist from gases flowing in the breather chamber 18*a* through the valve chamber 18. The valve chamber 18 has a second hole or opening 18*c* through which the valve chamber 18 and the first breather chamber 18*a* communicate together.

The power takeout shaft 17 projects backwards from the lubricating unit 40 and coupled with a drive shaft 4*a* (FIG. 1) of the jet pump 4. The power takeout shaft 17 has a first connecting portion 17*a* adapted to be connected to the crankshaft 15 and a second connecting portion 17*b* adapted to be connected to the jet pump drive shaft 4*a* for taking out power from the engine unit 3 and transmitting the engine power to the jet pump 14 (FIG. 1). The connecting portions 17*a*, 17*b* may be formed by an internal spline or an internal screw.

The crankcase lower half 11 (hereinafter referred to, for brevity, as "crankcase") is a one-piece molded member and has four bearing members or portions 11*a* disposed at the bottom of the crank chamber 19 for rotatably supporting the crankshaft 15. The bearing portions 11*a* are spaced at predetermined intervals in the longitudinal direction of the crankshaft 15 so that there are three oil sump portions 11*b* formed at the bottom of the crank chamber 19 between adjacent pairs of the bearing portions 11*a* for temporarily holding therein a lubricating oil which falls down from moving parts of the engine unit 3 after circulating through the engine for lubrication. The crankcase 11 further has a guide passage 11*c* interconnecting the oil sump portions 11*b* at one end for guiding the lubricating oil from the oil sump portions 11*a* to a return passage 11*d*. The return passage 11*d* is also formed in the crankcase 11 for the passage therethrough of the lubricating oil as the lubricating oil is recovered into the lubricating unit 60. The oil sump portions 11*b* communicating together through the guide passage 11*c* jointly form an oil sump. The guide passage 11*c* preferably has a downward slope toward the return passage 11*d*.

The oil sump portions 11*b* are designed to hold a small quantity of lubricating oil and they are closed by a plurality (three in the illustrated embodiment) of baffle plate pieces 21. The baffle plate pieces 21 are located close to the crankshaft 15 to such an extent that they do not interfere with counterweights on the crankshaft 15. With the baffle plate pieces 21 thus provided, the lubricating oil in the oil sump portions 11*b* is prevented from splashing over the crankshaft 15 which would otherwise increase the friction loss of the crankshaft 15.

The valve drive mechanism 40 is a belt drive unit designed to drive the camshaft 31 of the valve mechanism 30 using rotational power of the crankshaft 15. The valve drive mechanism 40 includes a drive pulley 41 secured to one end (front end) of the crankshaft 15 projecting from a front end face of a cylinder-block-and-crankcase assembly 20 (i.e., the engine body 10), a drive pulley 42 secured to one end (front end) of the camshaft 31 projecting from a front end face of the cylinder head 13 (i.e., the engine body 10), a timing belt 43 trained around the drive and drive pulleys 41, 42, and a belt tensioner 44 for adjusting the tension in the timing belt 43. The drive pulley 42 and the timing belt 43 are covered by a belt cover 45. The cylinder-block-and-crankcase assembly 20 is composed of the cylinder block 12 and the crankcase 11 assembled together. And, the front end face of the cylinder-block-and-crankcase assembly 20 is perpendicular to an axis of the crankshaft 15.

The flywheel unit 50 includes a flywheel 51 bolted to the front end of the crankshaft 15 with the drive pulley 41 disposed between the flywheel 51 and the cylinder-block-and-crankcase assembly 20, a ring-shaped wheel case 52 bolted to the front end face of the cylinder-block-and-crankcase assembly 20 and encircling the flywheel 51, and a flat plate-like cover 53 bolted to the flywheel case 52 so as to close an open end (front end) of the flywheel case 52. The flywheel unit 50 as a whale is attached to the front end face of the cylinder-block-and-crankcase assembly 20.

An alternator 54 includes an annular rotor 54*a* attached to an inner circumferential surface of the flywheel 51, and an annular stator coil 54*b* attached to the flywheel case 52 in such a way that there is an air gap between the rotor 54*a* and the coil 54*b*. A ring gear 55 is attached to an outer circumferential surface of the flywheel 51 and operatively connected to a starter motor 56 (FIG. 7), described later. An upper end portion of the wheel case 54 has a radial through-hole (not designated) provided for checking the crank angle. The through-hole is normally closed by an inspection cap 57.

The lubricating unit 60 generally comprises a lubricating oil tank 59 assembled with a rear end face 22 of the cylinder-block-and-crankcase assembly 20, a recovery pump 64 for sending the lubricating oil from the oil sump portions 11*b* of the crankcase 11 back into the lubricating oil tank 59, a feed pump 65 for supplying the lubricating oil from the lubricating oil tank 59 to moving parts in the engine body 10, and a plurality of passage means which interconnect the lubricating oil tank 59, the recovery pump 64 and the feed pump 65. The lubricating oil tank 59 is composed of a tank body 61 attached by screws to the cylinder-block-and-crankcase assembly 20, and an end cover 63 attached to the tank body 61 so as to close an open end of the tank body 61. The open end of the tank body 61 faces in a direction away from the rear end face 22 of the cylinder-block-and-crankcase assembly 20. The recovery pump 64 is built in the lubricating oil tank 59, and the feed pump 65 is disposed separately from the lubricating oil tank 59.

The rear end face 22 of the cylinder-block-and-crankcase assembly 20 extends perpendicularly to the axis of the crankshaft 15 and forms a packing surface (or a flange) for attachment of the tank body 59 to the engine body 10. The tank body 61 includes an end wall 61*v* facing toward the packing surface 22, and a sidewall (peripheral wall) 61*w* integral with the end wall 61*v* and projecting from the end wall 61*v* in a direction away from the packing surface 22 of the cylinder-block-and-crankcase assembly 20 in parallel relation to the axis of the crankshaft 15. The tank body 61 is open at a front end of the sidewall 61*w*. The tank body 61 has a pair of parallel spaced first and second packing surfaces (flanges) 61*a* and 61*b*. The first packing surface 61*a* faces toward the packing surface 22, and the second packing surface 61*b* faces in a direction away from the packing surface 22. The tack body 61 and the cylinder-block-and-crankcase assembly 20 are connected together by screws with a first packing 23 disposed between the first packing surface 61*a* and the packing surface 22. The end cover 63 and the tank body 61 are connected together by screws with a second packing 62 disposed between the second packing surface 61*b* and a packing surface (flange) 63*a* of the end cover 63. Thus, the lubricating oil tank 59 is of the closed type which is sealed between the cylinder-block-and-crankcase assembly 20 and the end cover 63. In the case where the packing surface (rear end surface) 22 and the first packing surface 61*a* can themselves form a hermetic seal therebetween, the first packing 23 can be omitted. Similarly, the second packing 62 can be omitted when the second packing surface 61*b* and the packing surface 63*a* can form a hermetic seal therebetween.

The recovery pump 64 is a scavenging pump and includes a generally tubular casing 61*c* formed integrally with the lubricating oil tank 59, an end cover 64*a* closing one open end of the tubular casing 61*c*, an inner rotor 64*b* and an outer rotor 64*c* that are received in the casing 61*c*, and a shaft 64*f* connected by a drive mechanism (composed of a drive gear 64*d* and a driven gear 64*e*) to the crankshaft 15 for rotating the inner and outer rotors 64*b*, 64*c*. The drive mechanism 64*d*, 64*e* is received in a recessed portion 66 of the rear end face 22 extending around the crankshaft 15. The recessed portion 66 is substantially closed by the tank body 61. The recessed portion serves also as part of a breather passage which interconnects the valve chamber 18 and the crank chamber 19. The end cover 64*a* of the recovery pump 64 is attached by screws (one being to the casing 61*c* of the recovery pump 64.

At lease one of the second packing surface 61*b* of the tank body 61 and the packing surface 63*a* of the end cover 63 is formed with oil passages associated with the recovery pump 64. In the illustrated embodiment, the second packing surface 61*b* has an intake passage part or half 61*e* and a discharge passage part or half 61*f*, while the packing surface 63*a* has an intake passage part or half 63*c* and a discharge passage part or half 63*d*. The intake passage halves 61*e* and 63*c* together form an intake passage of the recovery pump 64, and the discharge passage halves 61*f* and 63*d* together form a discharge passage of the recovery pump 64. The intake passage half 61*e* communicates with the return passage 11*d* of the crankcase 11.

The feed pump 65 is comprised of a tubular casing 65*a* attached by screws (one being shown) to a rear end face of the cylinder head 13, an end cover 65*b* attached to an end of the casing 65*a* so as to close an open end of the casing 65*a*, an inner rotor 65*c* and an outer rotor 65*d* both received in the casing 65*a*, and a shaft 65*e* directly coupled to the camshaft 31 of the valve drive mechanism 30 for rotating the inner and outer rotors 65*c*, 65*d*.

The shaft 64*f* of the recovery pump 64 and the shaft 65*e* of the feed pump 65 extend parallel to the axis of the crankshaft 15 and the axis of the camshaft 31.

An assembly composed of the cylinder block 12 and the cylinder head 13 has an intake passage 24*a* and a discharge passage 24*b* (FIG. 8) both associated with the feed pump 65. In FIG. 3 reference numerals 58, 58 denote hungers used for supporting the engine unit 3 on the hull 2 or the boat 1.

Figure 4:
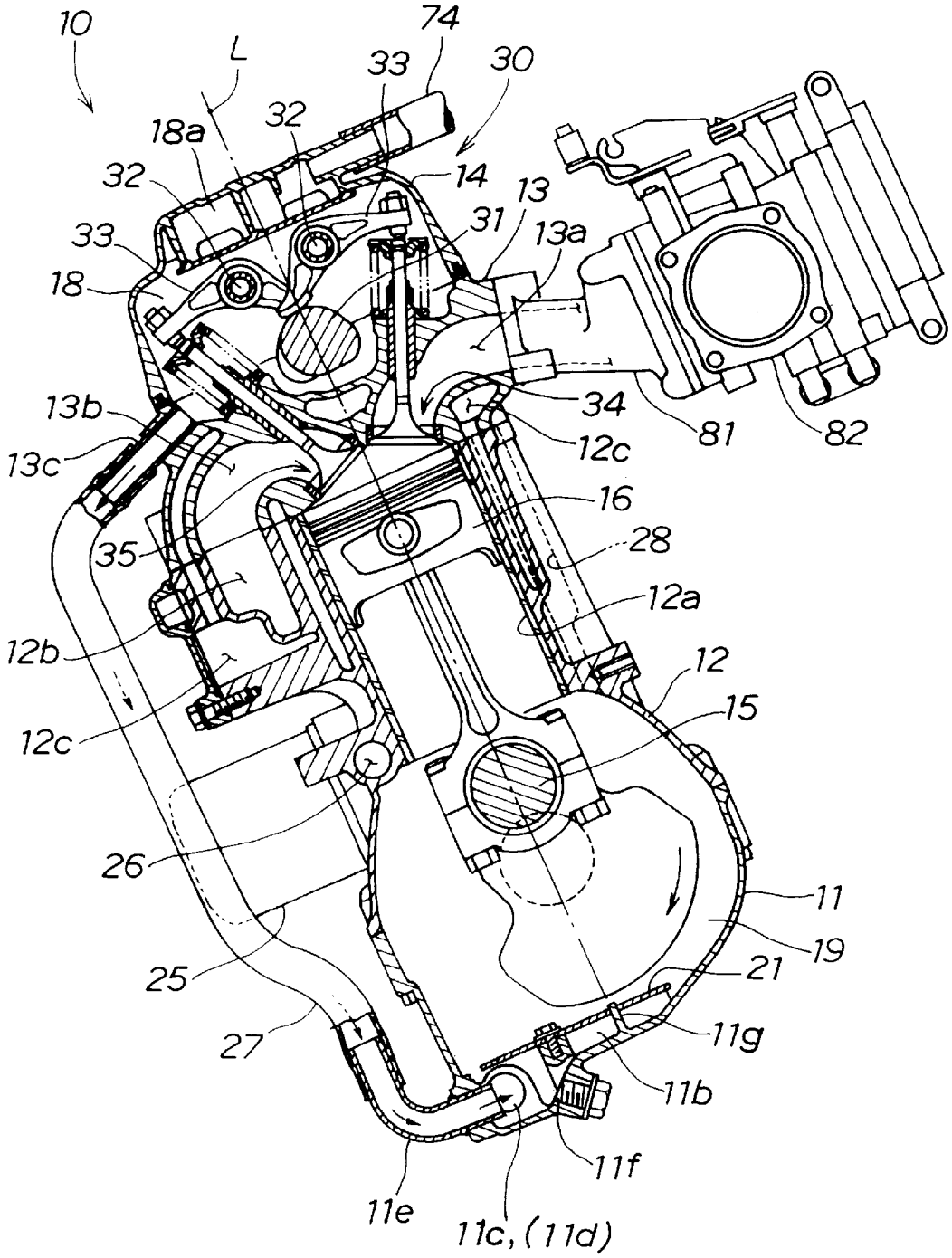
FIG. 4 is a vertical cross-sectional view of an engine body of the engine.

Reference is made to FIG. 4 which shows in vertical cross section the engine body 10 of the engine unit 3 shown in FIG. 2. As shown in this figure, the valve mechanism 30 includes the aforesaid camshaft 31, two rocker shafts 32 disposed on opposite sides of the camshaft 31, two rocker arms 33, 33 pivotally mounted the rocker arms 33, 33, an intake valve 34 driven by one of the rocker arms 33, 33, and an exhaust valve 35 driven by the other rocker arm 33. The rocker arms 33, 33 and the intake and exhaust valves 34, 34 shown in FIG. 4 are associated with one of the three cylinders 12*a* of the engine unit 3.

The cylinder head 13 has an intake port 13*a* and an exhaust port 13*b*. The intake port 13*a* communicates with a float-less diaphragm carburetor 82 through an intake manifold 81. The exhaust port 13*b* communicates with an exhaust passage 12*b* formed in the cylinder block 12.

As described above, the head cover 14 includes the first breather chamber 18*a* disposed at an upper portion of the valve chamber 18 for returning blowby gases to an intake system or line of the engine unit 3.

The baffle plate pieces 21 are secured to a bottom portion of the crankcase 11 so as to isolate a lower part of the crank chamber 18 which is located on a downstream side (left side in FIG. 4) of the crankshaft 15 when viewed in the direction of rotation of the crankshaft 15.

The cylinder axis L is inclined from the vertical to the left, and so the guide passage 11*c* and the return passage 11*d* are disposed on the bottom left of the crank chamber 18 which is located on the same side as the direction of inclination of the cylinder axis L. The oil sump portions 11*b* (one being shown) have a downward slope toward the guide passage 11*c* so that the lubricating oil collected in the oil sump portions 11*b* can flow smoothly from the oil sump portions 11*b* into the guide passage 11*c*. Thus, to recover the lubricating oil from the oil sump portions 11*b* to the lubricating oil tank 59, the lubricating system requires only one set of recovery line (composed of the guide passage 11*c* and the return passage 11*d*) and the recovery pump 64. The lubricating system thus constructed is relatively simple in construction and inexpensive to manufacture.

In the case of an engine unit with a cylinder axis L inclined from the vertical to the right in FIG. 2, the guide and return passages 11*c* and 11*d* are located on the bottom right side of the crank chamber 18.

The cylinder block 12 has an oil supply passage 26 communicating with feed pump 65 (FIG. 8) through the discharge passage 24*b* (FIG. 8) and a filter 25 for supplying the lubricating oil to the moving parts in the engine unit 3. The lubricating oil in the valve chamber 18 falls down into the crank chamber 18 through an oil return tube 27 which is connected at one end to a pipe 13*c* on the cylinder head 13 and at the opposite end to a pipe 11*e* on the crankcase 11. The pipe 13*c* communicates with the valve chamber 18, and the pipe 11*e* communicates with the guide passage 11*c* and the oil sump portions 11*b*. The engine body 19 further has a connecting passage 28 extending between the valve chamber 18 and the crank chamber 19, a drain hole 11*f* formed at the bottom of the crankcase 11 for removing the lubricating oil from the oil sump portions 11*b*, and a water jacket for the passage of a coolant (engine cooling water).

Figure 5A:
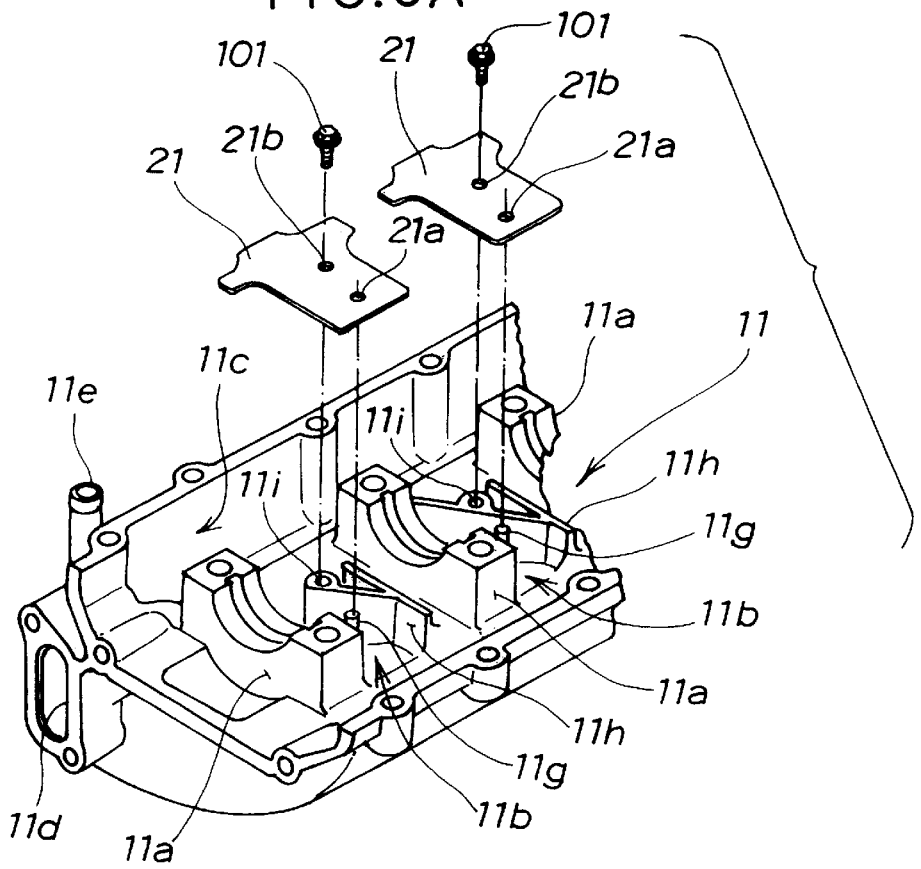
FIG. 5A is an exploded fragmentary perspective view showing the manner in which baffle plate pieces are attached to a crankcase of the engine body.
Figure 5B:
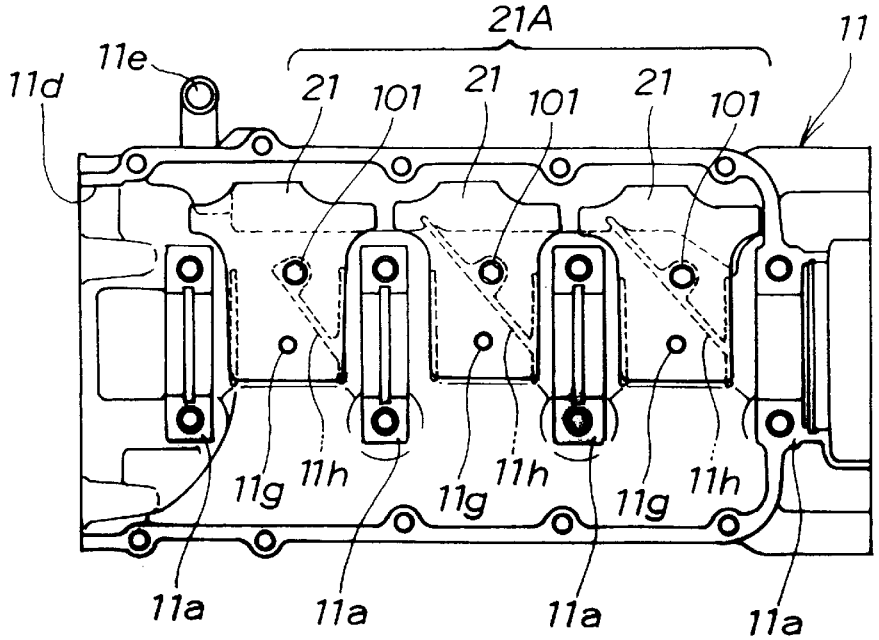
FIG. 5B is a plan view of the crankcase shown with the baffle plate pieces attached thereto.

As best shown in FIGS. 5A and 5B, each of the baffle plate pieces 21 are disposed over one of the oil sump portions 11*b* each defined between one pair of adjacent bearing portions 11*a*. The baffle plate pieces 21 jointly form a baffle plate assembly 21A (FIG. 5B). The crankcase 11 includes a positioning pin 11*g* and a plate support lug 11*h* that are projecting from a bottom surface of the crankcase 11 into each of the oil sump portion 11*b*. The plate support lug 11*h* has a threaded hole 11*i* and extends preferably diagonally across the oil sump portion 11*b*. The positioning pin 11*g* is disposed substantially centrally between the adjacent bearing portions 11*b* and extends beyond an upper surface of the plate support lug 11*h*. Threaded hole 11*i* is slightly offset from the positioning pin in a direction parallel to the axis of the crankshaft 15 for a purpose described below.

The baffle plate pieces 21 are press-formed from a sheet metal into an identical configuration. The baffle plate pieces 21 have a generally T shape including a head adapted to extend over a longitudinal portion of the guide passage 11*c* and a stem adapted to extend over each oil sump portion 11*b*. Each of the baffle plate pieces 21 has a guide hole 21*a* for snugly receiving therein the positioning pin 11*g*, and a through-hole 21*b* for the passage of a screw 101 which is threaded into the threaded hole 11*i* in the plate support lug 11*h* to secure the baffle plate piece 21 to the plate support lug 11*h*.

As described above, the baffle plate assembly 21A is composed of a plurality of press-formed baffle plate pieces 21 of identical configuration. This forms a clear contract to the conventional baffle plate which is formed by a single press-formed elongated metal sheet of a complicated configuration so profiled as to cover spaces between the adjacent bearing portions to form oil sump portions. It is therefore understood that a mold used for press-forming of the baffle plate pieces 21 is small in size, simple in construction and inexpensive to manufacture as compared to a mold used for press-forming of the conventional baffle plate. Use of such small, simple and inexpensive mold is contributive to the reduction of manufacturing cost of the engine unit 3.

To attach the baffle plate pieces 21 to the oil sump portions 11*b*, each of the baffle plate pieces 21 is set on a corresponding one of the plate support lugs 11*h* in such a way that the guide hole 21*a* fits with the positioning pin 11*g* and the through-hole 21*b* is aligned with the threaded hole 11*i* in the plate support lug 11*h*. Then, one of the screws 101 is threaded through the through-hole 21*b* into the threaded hole 21*b* in the plate support lug 11*h* to firmly secure the baffle place piece 21 to the plate support lug 11*h*.

By virtue of the offset between the positioning pin 11*g* and the threaded hole 21*b* (and also between the guide hole 21*a* and the through-hole 21*b*) in the axial direction of the crankshaft 15 (FIG. 3), if any of the baffle plate pieces 21 is placed front side down onto one of the plate support lugs 11*h*, the guide hole 21*a* and the through-hole 21*b* of the baffle plate piece 21 do not register with the positioning pin 11*g* and the threaded hole 11*i*, respectively. Additionally, because the generally T-shaped baffle plate pieces 21 are asymmetrical with respect to a center line laid perpendicularly to an axis of the crankshaft 15, an attempt to attached the baffle plate pieces 21 front side back to the plate support lugs 11*h* will be performed unsuccessfully due to to interference between the respective heads of the T-shaped baffle plate pieces 21 and the bearing portions 11*a* and a sidewall of the crankcase 11. The baffle plate pieces 21 can, therefore, be always attached correctly to the plate support lugs 11*h* of the crankcase 11.

Figure 6:
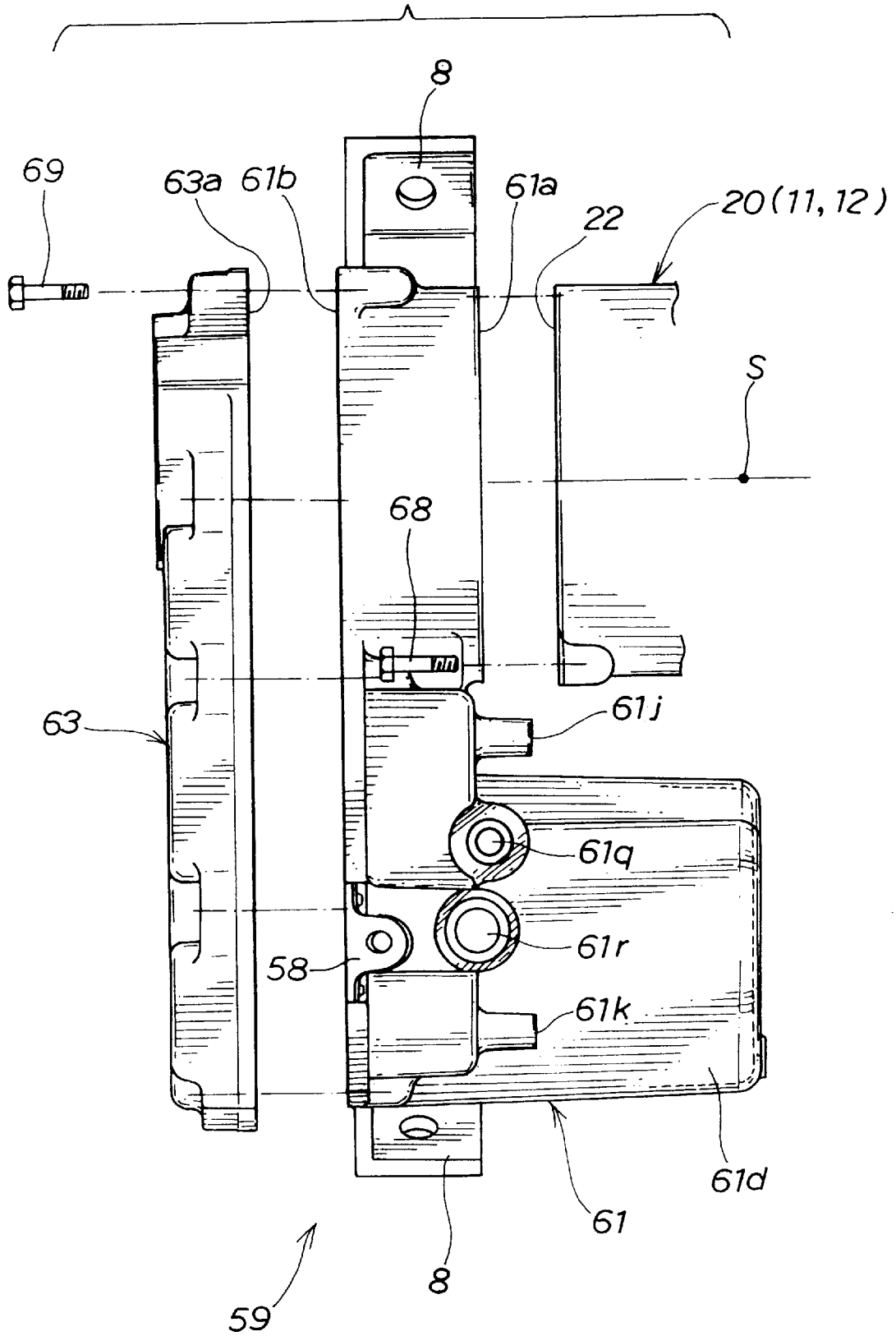
FIG. 6 is an exploded plan view of a lubricating oil tank of the engine.

FIG. 6 shows in exploded plan view the construction of the lubricating oil tank 59. The lubricating oil tank 59 includes a bulged portion 61*d* integral with the tank body 61 and extending parallel to an axis S of the crankshaft 15 along a side of the cylinder-block-and-crankcase assembly 20 in a direction toward the front end of the engine body 3 (FIG. 3) for holding therein the lubricating oil. With the bulged portion 61*d* thus provided, the lubricating oil tank 59 is made smaller in thickness and height than a tank having no such bulged portion on condition that the tank volume is constant. The lubricating oil tank 59 is therefor contributive to downsizing of the engine unit 3. In FIG. 6 reference character 61*r* denotes a filler cap attached to an inlet of the lubricating oil tank 59; 68, a screw used for attaching the tank body 61 to the cylinder-block-and crankcase assembly 20; and 69 is a screw for attaching the end cover 63 to the tank body 61.

Figure 7:
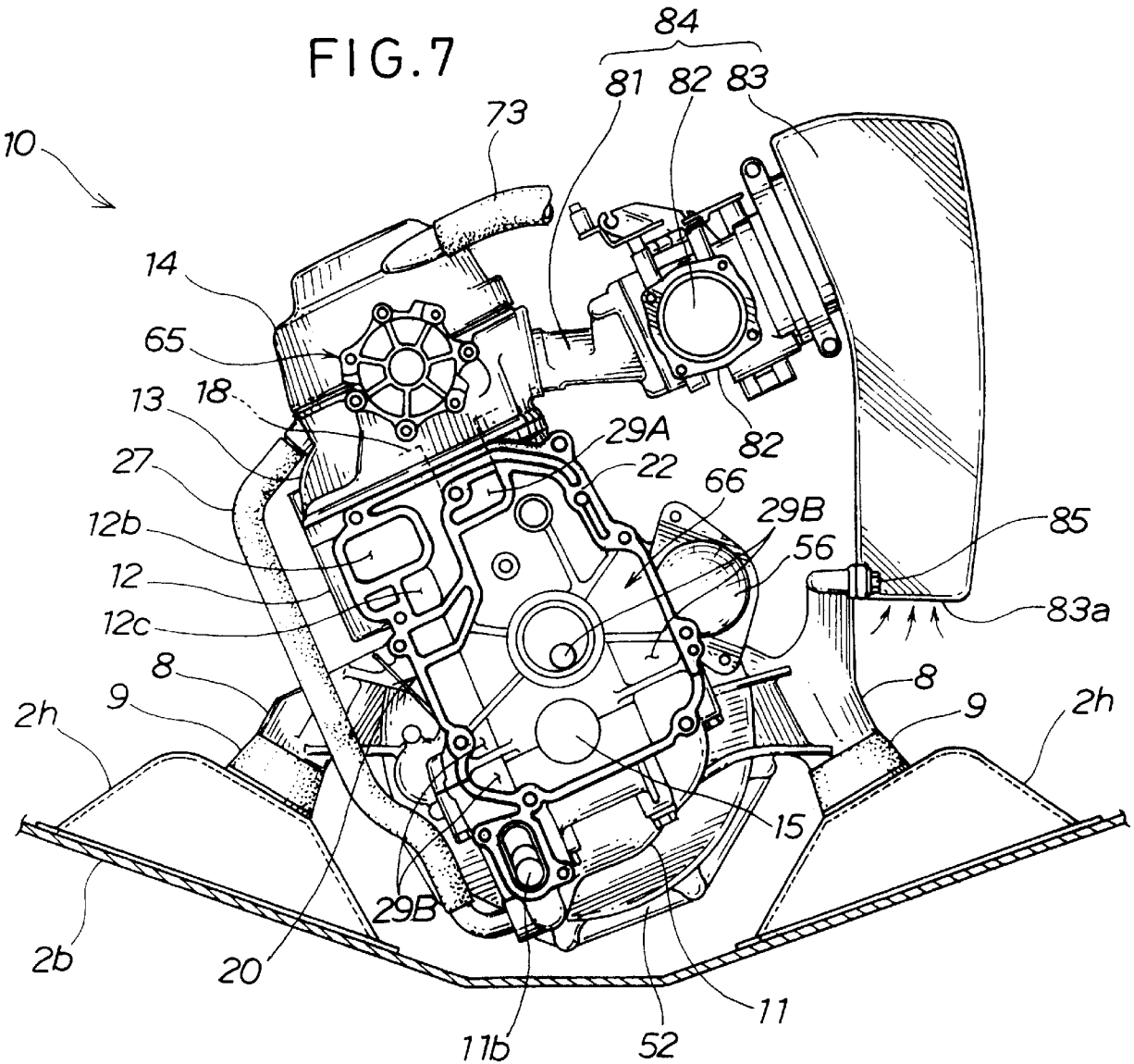
FIG. 7 is a rear elevational view of the engine shown with the lubricating oil tank removed therefrom.

Reference is made to FIG. 7 which shows in rear view the engine unit 3 with the lubricating oil tank 59 removed from the engine body 10. Thus, the packing surface 22 of the cylinder-block-and-crankcase assembly 20 is exposed. The engine body 10 has a plurality of second breather passages 29A, 29B, one 29A being communicated with the valve chamber 18, and the rest 29B being communicated with the crank chamber 19. The breather passage 29A and the breather passages 29B communicate with each other through a space (corresponding to the recessed portion 66 shown in FIG. 3) surrounded by the packing surface 22. Thus, the second breather passages 29A, 29B communicates the valve chamber 18 with the crank chamber 19. The starter motor 56 rotates the flywheel 51 (FIG. 3) via the ring gear 55 (FIG. 3) to start the engine unit 3. The carburetor 82 is connected to an induction box (also called intake silencer) 83. The intake manifold 81, the carburetor 82 and the induction box 83 form an intake line or system 84 of the engine unit 3. The induction box 83 has an air inlet 83*a* ans is attached by screws (one being shown) to the mount 8 of the engine body 10.

Figure 8:
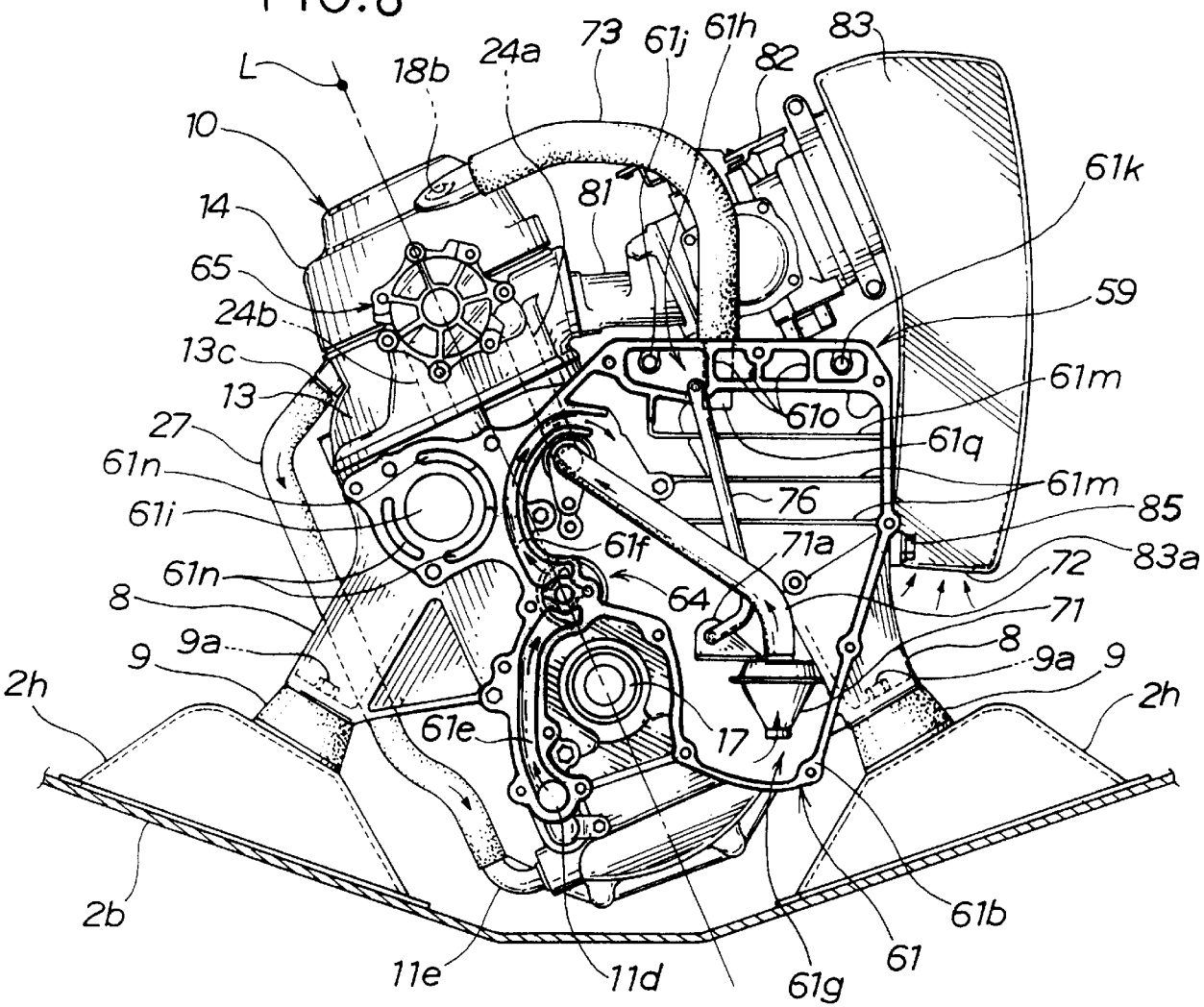
FIG. 8 is a view similar to FIG. 7, but showing the engine having the lubricating oil tank with an end cover removed therefrom.

FIG. 8 is a view similar to FIG. 7, but showing the engine unit 3 with the end cover 63 removed from the tank body 61. Thus, the second packing surface 61*b* of the tank body 61 is exposed to view. The tank body 61 has the intake passage portion 61*e* for guide the lubricating oil into the recovery pump 64, the discharge passage portion 61*f* for guiding the lubricating oil from the recovery pump 64 into the tank body 61, an oil holding portion 61*g* contiguous with the bulged portion 61*d* (FIG. 6) and holding therein the lubricating oil, a second breather chamber 61*h* disposed above the oil holding portion 61*g,* and an engine exhaust hole 61*i* connecting the exhaust passage 12*b* (FIG. 7) and an exhaust manifold (not shown).

The second breather chamber 61*h* is located at a lower level than the valve chamber 18 and the first breather chamber 18*a* shown in FIG. 3 and serves to separate oil mist from gases which has moved into the second breather chamber 61*h* past the first breather chamber 18*a*.

The intake passage portion 61*e* and the oil holding portion 61*g* of the tank body 61 are disposed on opposite sides of the power takeout shaft 17 astride the power takeout shaft 17. The recovery pump 64 is disposed directly above the power takeout shaft 17, and the feed pump 65 is disposed directly above the recovery pump 64.

An oil pickup pipe 72 extends into the oil holding portion 61*g* of the tank body 61 and has a strainer 71 attached to a lower end of the oil pickup pipe 72. The oil pickup pipe 72 have an upper portion extending through a rear wall of the cylinder block 12 and connected at an upper end to the intake passage 24*a* (FIG. 3) of the feed pump 65. The strainer 71 is located close to the bottom of the tank body 61 and supported stably in position by a support stay 71*a* attached to the tank body 61. The tank body 61 has a plurality (three being shown) of vertically spaced horizontal baffle walls 61*m* formed on the oil holding portion 61*g* for preventing splashing of the lubricating oil, and water jackets 61*n* provided around the engine exhaust hole 61*i* and interconnecting the water jacket 12*c* (FIG. 7) and an external pipe (not shown) for the passage of the coolant (cooling water). A first breather tube 73 communicates the interior of the lubricating oil tank 59 with the valve chamber 18 (FIG. 3) through a gas outlet 61*q* of the tank body 61. In FIG. 8 reference numeral 9*a* denotes a bolt used for mounting the engine unit to the hull of the boat.

Figure 9:
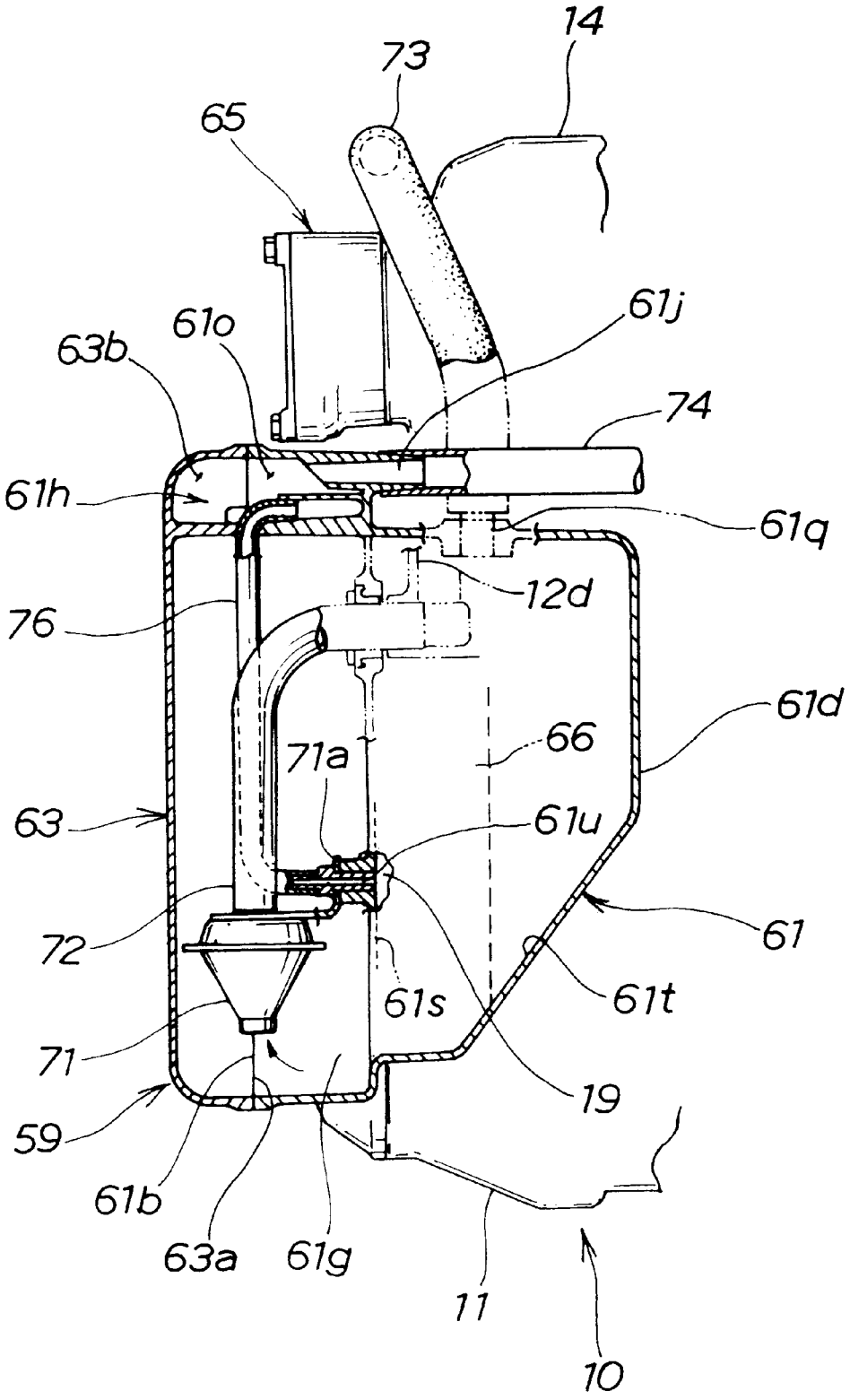
FIG. 9 is a vertical cross-sectional view of the lubricating oil tank.

As shown in FIG. 9 which is a vertical cross-sectional view of the lubricating oil tank 59, the bulged portion 61*d* of the tank 59 extends along one side of the engine body 10 and projects toward the front end of the engine body 10. The bulged portion 61*d* has an upper end substantially flush with an upper end of the tank body 61 and a lower portion 61*t* tapering toward a lower end of the tank body 61. With the tank 59 thus constructed, the strainer 71 can be always kept immersed in the lubricating oil even when the engine unit 3 is caused to tilt due to pitching and rolling of the boat 1. The lubricating oil tank 59 has an oil return tube 76 substantially contained therein. The oil return tube 76 has an upper end connected to the second breather chamber 61*h,* and a lower end connected to a wall portion 61*s* of the tank body 61. The wall portion 61*s* has a hole 61*u* through which the oil return tube 76 communicates with the crank chamber 19. Thus, the lubricating oil in the second breather chamber 61*h* cal fall down into the crank chamber 19 through the oil return tube 76 and the hole 61*u* in the tank body wall portion 61*s*. The second breather chamber 61*h* has a labyrinth structure, as described below with reference to FIG. 10.

Figure 10:
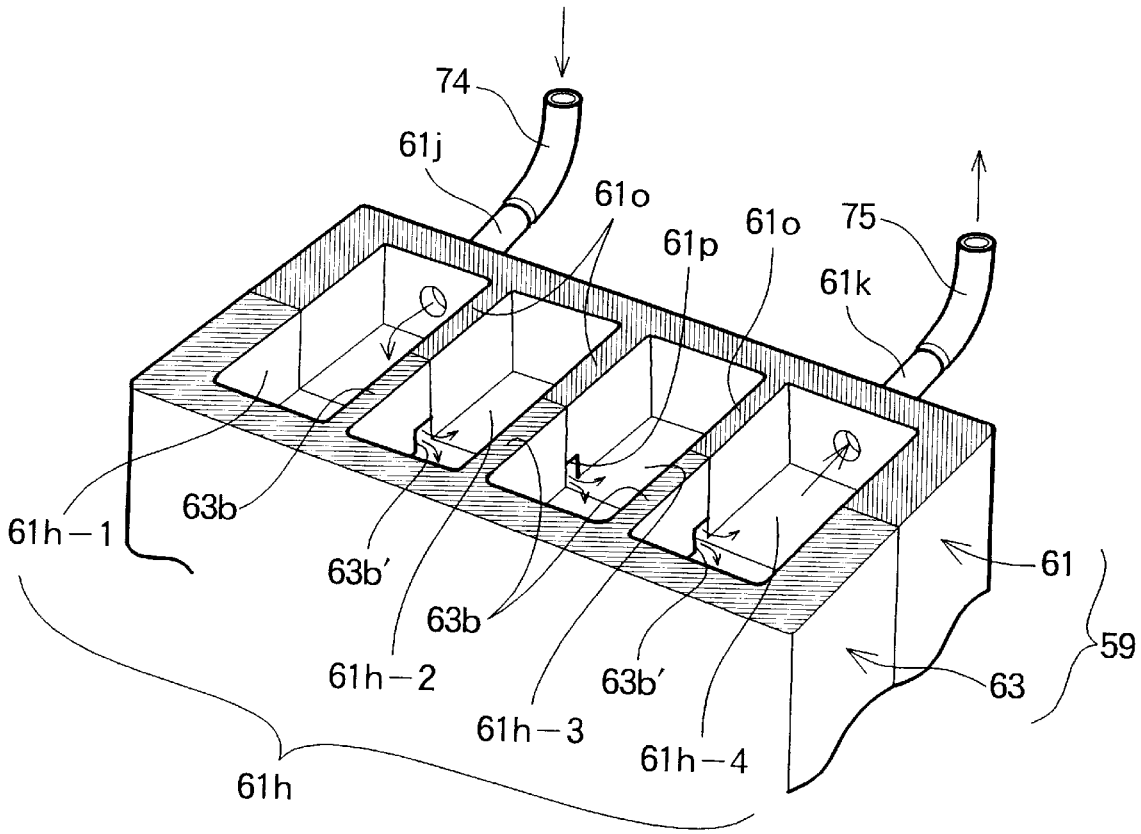
FIG. 10 is a cross-sectional perspective view of an upper portion of the lubricating oil tank showing the structure of a breather chamber.

As shown FIG. 10, the second breather chamber 61*h* is divided into four breather compartments 61*h*-1, 61*h*-2, 61*h*-3, 61*h*-4 by three partition walls 61*o* of the tank body 61 and three partition walls 63*b* of the end cover 63 held in abutment with the partition walls 61*o* of the tank body 61. The breather compartments 61*h*-1, 61*h*-2, 61*h*-3, 61*h*-4 communicate together through small opening or orifices 63*b*', 61*p,* 63' arranged in a zigzag fashion along a parting plane between the tank body 61 and the end cover 63. The second breather chamber 61*h* partitioned to have at least three breather compartments 61*h*-1, 61*h*-2, 61*h*-3, 61*h*-4 communicating with each other through the orifices 63*b*', 61*p* arranged zigzag has a labyrinth structure.

The second breather chamber 61*h* has a gas inlet pipe 61*j* connected by a second breather tube 74 to the first breather chamber 18*a* (FIG. 4) of the valve chamber 18, and a gas outlet pipe 61*k* connected by a third breather tube 75 to an upstream side of the carburetor 82 (engine intake system 84).

Figure 11:
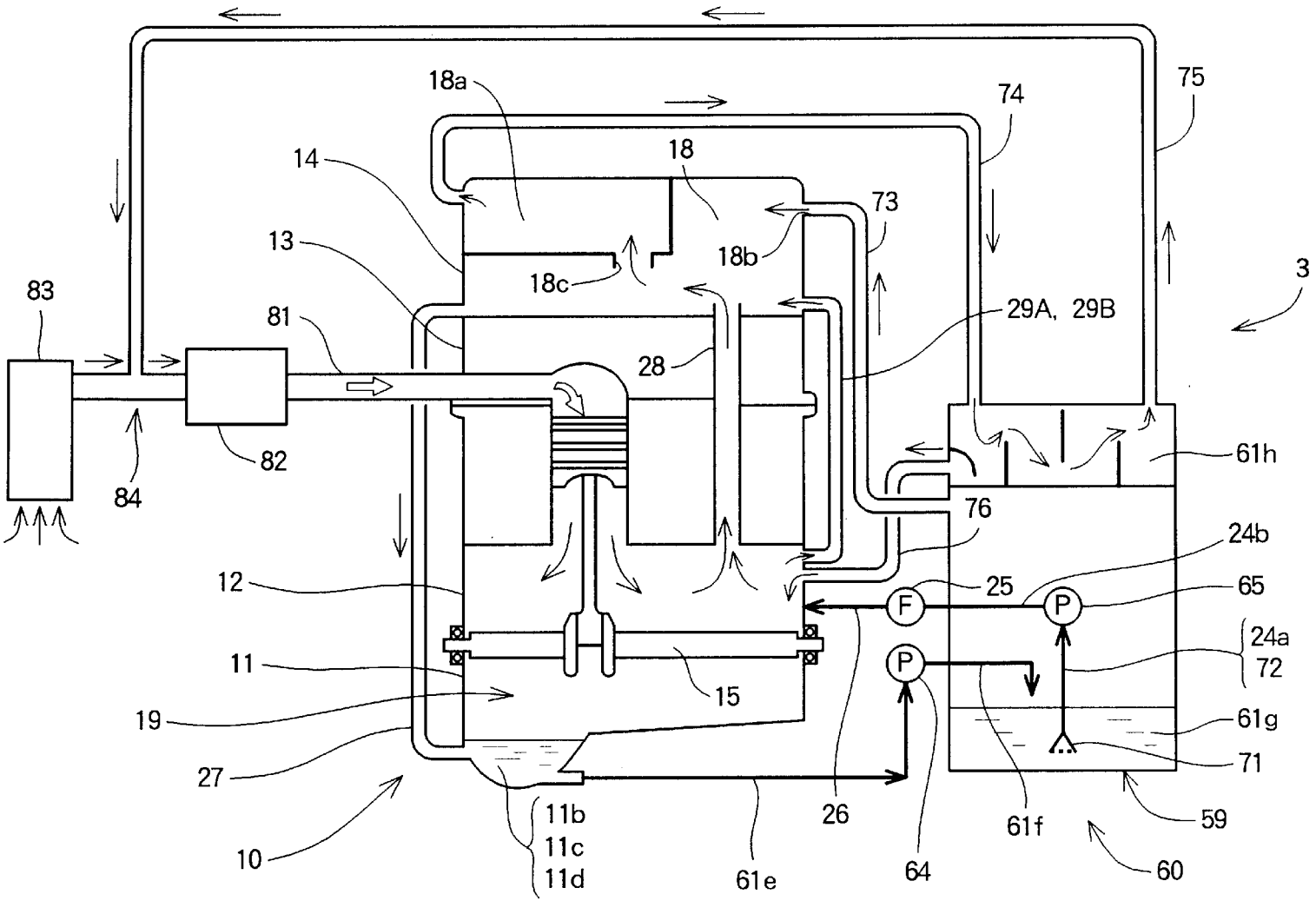
FIG. 11 is a diagrammatical view showing the general arrangement of the lubricating system and a breather system of the engine.

Reference is made to FIG. 11 which diagrammatically shows a lubricating system and a breather system of the engine unit 3.

The lubricating system is constructed to supply lubricating oil from the lubricating oil tank 59 to moving parts in the engine body 10 under the operation of the feed pump 65 and recover the lubricating oil from the oil sump portions 11*b* at the bottom of the crank chamber 19 into the lubricating oil tank 59 under the operation of the recovery pump 64.

The breather system operates to separate oil mist from gases such as blowby gas in the crank chamber 19 and return the gases to the engine intake line or system 84.

The breather system includes a first hole or opening 18*b* formed in the valve chamber 18, a second hole or opening 18*c* formed in the valve chamber 18 and located below the first opening 18*b,* the first and second breather passages 28 and 29A, 29B extending between the valve chamber 18 and the crank chamber 19 to connect them in fluid communication with each other, the first breather tube 73 extending between the lubricating oil tank 59 and the first opening 18*b* of the valve chamber 18 to connect the tank 59 and the valve chamber 18, the first breather chamber 18*a* disposed below an upper end of the head cover 14 for separating liquid oil from blowby gas and oil vapors, the first breather chamber 18*a* being communicated with the valve chamber 18 through the second opening 18*c,* the second breather chamber 61*h* disposed below the first breather chamber for further separating liquid oil from blowby gas and oil vapors, the second breather tube 74 extending between the first breather chamber 18*a* and the second breather chamber 61*h* to connect them in fluid communication with each other, and the third breathe tube 75 extending between the second breather chamber 61*h* and the intake system 84 of the engine unit 3.

Since the lubricating oil tank 59 is attached to the rear end face of the cylinder-block-and-crankcase assembly 20 and has a portion (bulged portion) extending along a side of the engine body 10, the overall height of the engine unit 3 is smaller than that of an conventional engine having a lubricating oil tank disposed above or below the crank chamber. Additionally, because the first and second breather chambers 18*a,* 61*h* are disposed between the lower end of the crankcase 11 and the upper end of the head cover 14, these breather chambers 18*a,* 61*h* do no increase the overall height of the engine unit 3. The engine unit 3 as a while is compact as compared to the conventional engine unit.

Operation of the lubricating system of the engine unit 3 will be described with reference to FIG. 11.

While the engine unit 3 is running, the feed pump 65 driven by the crankshaft 15 of the engine unit 3 supplies the lubricating oil from the lubricating oil tank 59 to moving parts in the engine unit 3. More specifically, the lubricating oil held in the oil holding portion 61*g* of the lubricating oil tank 59 is formed to flow through a lubricating oil supply line (composed of the strainer 71, oil pickup pipe 72, feed pump 65, discharge passage 24*b*, filter 25, and the oil supply passage 26) and supplied to the moving parts of the engine unit 3.

After circulating through the engine unit to lubricate the engine moving parts, the lubricating oil falls down back into the crank chamber 19 and gathers into the oil sump portions 11*b*. In this instance, part of the lubricating oil returns from the valve chamber 18 to the return passage 11*d* through the oil return tube 27. The recovery pump 64 also driven by the crankshaft 15 picks up the lubricating oil from the oil sump portions 11*b* and sends the lubricating oil back to the oil holding portion 61*g* of the lubricating oil tank 59 through a lubricating oil recovery line (composed of the guide passage 11*c*, return passage 11*d*, intake passage 61*e*, recovery pump 64, and discharge passage 61*f*).

The breather system of the engine unit 3 operates as follows.

When the engine unit 3 is in operation, compressed air-fuel mixture and burned gases (i.e., blowby gases) leak past piston rings (not designated) into the crank chamber 19. Additionally, mist and vapors of the lubricating oil are also generated in the crank chamber 19. The blowby gases, mist and vapors move through the first and second breather passages 28, 29A, 29B into the valve chamber 18. Oil vapors generated in the lubricating oil tank 59 also flow into the valve chamber 18 through the first breather tube 73.

The blowby gases, mist and vapors (hereinafter referred to as "gases") in the valve chamber 18 flows through the second opening 18*c* into the first breather chamber 18*a* where oil mist in the gases is partly removed. Then the gases leave the first breather chamber 18*a*, advance through the second breather tube 74 and enter the second breather chamber 61*h* where oil mist remaining in the gases is substantially removed. Subsequently the gases leave the second breather chamber 61*h* and is returned through the third breather tube 75 into the intake line or system 84 of the engine unit 3 for burning in combustion chambers in the engine unit 3.

Behavior of the lubricating oil occurring in response to a change in posture of the engine unit 3 will be described with reference to FIGS. 12 and 13.

When the engine unit 3 is in the normal posture, as shown in FIG. 2, the lubricating oil O (indicated by hatching for clarity) is picked up from the bottom (oil sump portions 11*b*) of the crank chamber 19 and recovered into the oil holding portion 61*g* of the lubricating oil tank 59 by the recovery pump 64 driven by the engine unit 3.

Figure 13:
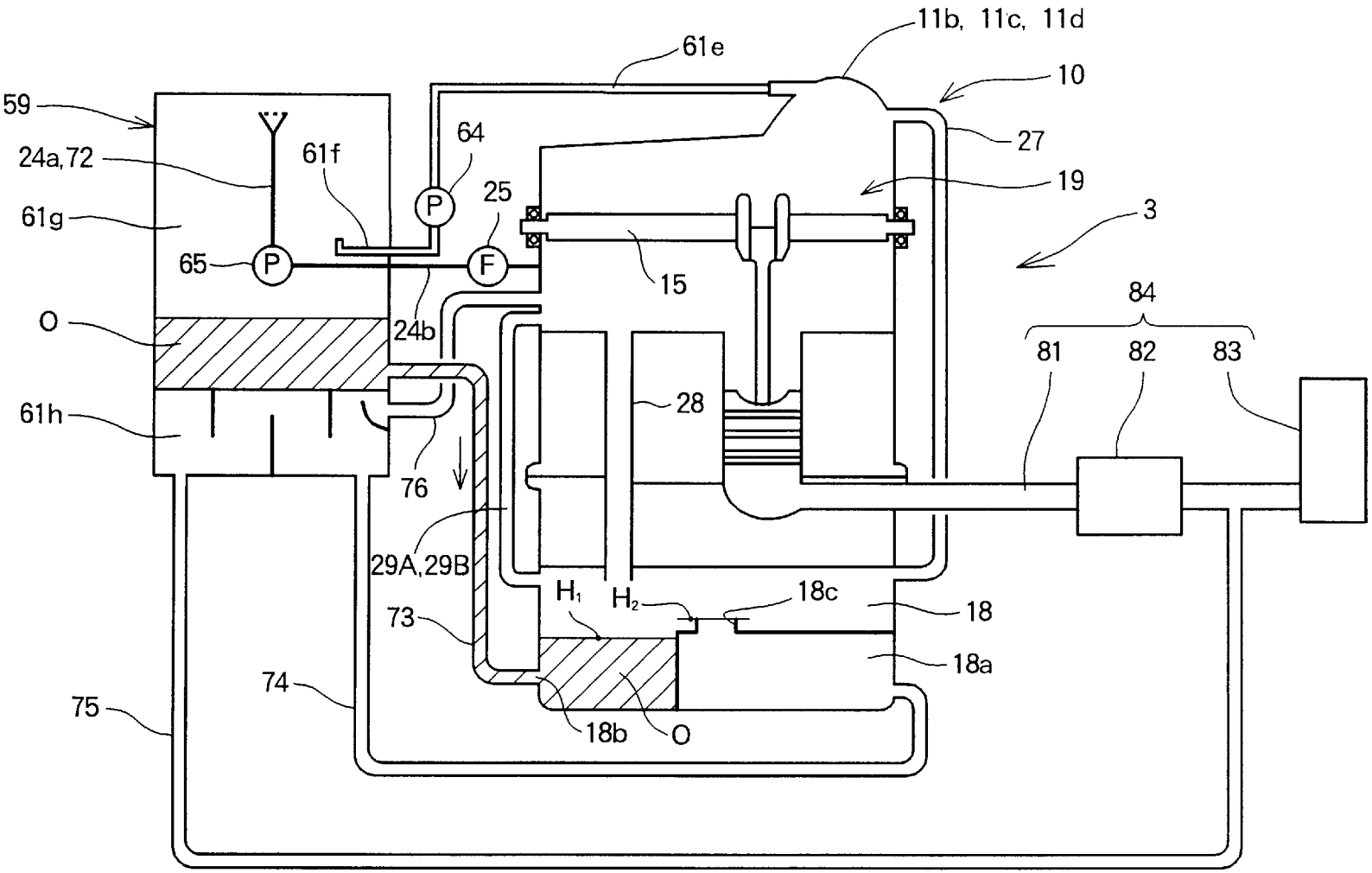
FIG. 13 is a view similar to FIG. 12, but showing the operation of the lubricating system and the breather system when the engine is in an inverted position or posture.

When the engine unit 13 is rolled through an angle of 180 degrees or overturned as shown in FIG. 13, the lubricating oil in the lubricating oil tank 59 is caused to flow downward through the first breather tube 73 and enters the valve chamber 18 through the first opening 18*b* in the valve chamber 18.

Overturn of the engine unit 3 causes the engine unit 3 to stop operation, and so the recovery pump 64 and the feed pump 65 both driven the crankshaft 15 are also stopped whereupon fluid communication between the intake passage and the discharge passage of each pump 64, 65 is blocked. Thus, upon rolling of the engine unit 3, the recovery and feed pumps 64, 65 serve as shutoff valves. With the valves (composed of the pumps 64, 65) thus closed, a vacuum is created in the lubricating oil tank 59, limiting the quantity of lubricating oil O allowed to flow into the valve chamber 18 to a predetermined value. In other words, when the engine unit 3 is turned upside down, the principle of "Torricellian vacuum" is applied where a vacuum is formed when the lubricating oil O in a long tube (composed of the lubricating oil tank 59 and the first breather tube 73) closed at one end is inverted with the open end in a reservoir of lubricating oil (composed of the valve chamber 18). By the action of the vacuum thus formed, only a predetermined quantity of lubricating oil can flow from the lubricating oil tank 59 into the valve chamber 18 even though the valve chamber 18 is located at a lower level than the lubricating oil tank 59.

In the condition shown in FIG. 13, the second opening 18*c* of the valve chamber 18 is located at a higher level than the first opening 18*a*. Additionally, the maximum level H1 of the lubricating oil which is permitted to flow into the valve chamber 18 is set to be below the level H2 of the second opening 18*c*. Accordingly, the lubricating oil O can never flow from the valve chamber 18 through the second opening 18*c* into the first breather chamber 18*a* and thence to the intake line or system 84 of the engine unit 3.

Figure 12:
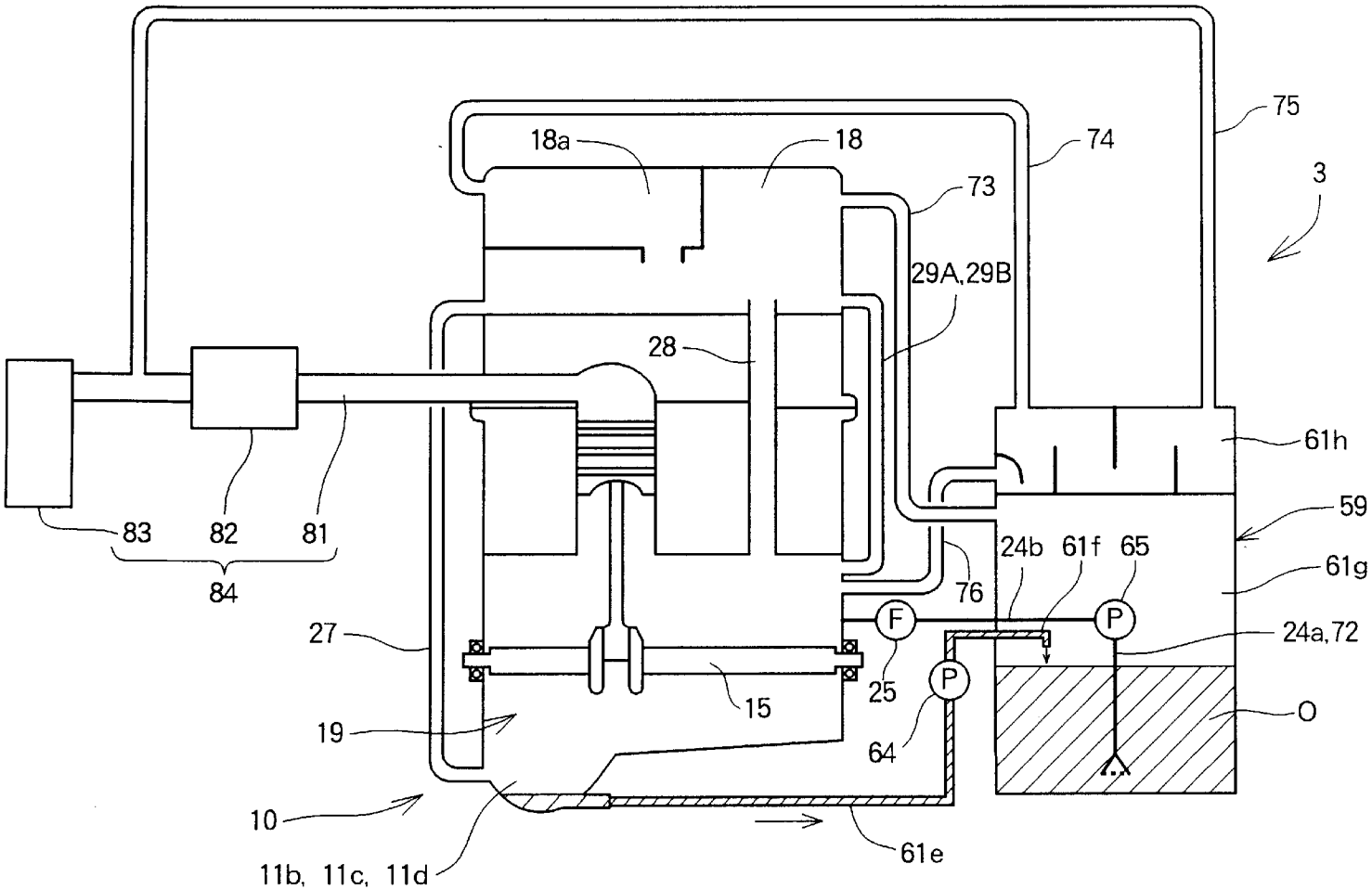
FIG. 12 is a diagrammatical view showing of the operation of the lubricating system and the breather system when the engine is in a normal position or posture.

When the engine unit 3 returns to its normal posture shown in FIG. 12, the lubricating oil O in the valve chamber 18 returns through the first breather tube 73 into the oil holding portion 61*g* of the lubricating oil tank 59. Thus, even when the engine unit 3 undergoes postural changes, the lubricating oil O in the breather system can be substantially recovered.

The postural changes of the engine unit 3 include overturning described above with reference to FIGS. 12 and 13 and rolling through an angle of less than 180 degrees from the normal posture.

The lubricating oil tank 59 can be removed from the engine body 10 and so it may be replaced with another lubricating oil tank in view of requirements for installation of the engine unit.

Figure 14:
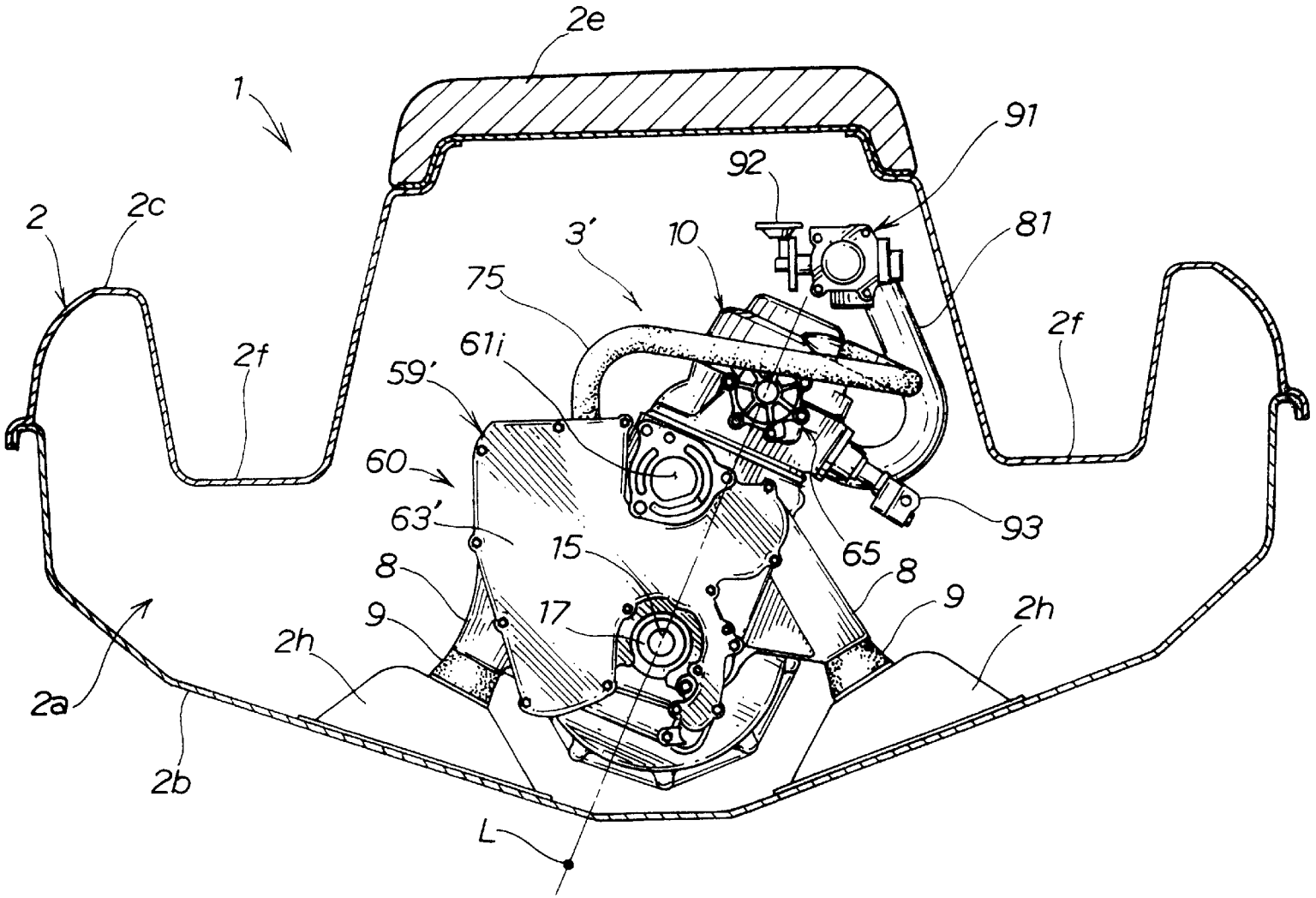
FIG. 14 is a view similar to FIG. 2, but showing a four-stroke-cycle internal combustion engine with dry sump lubricating system according to a second embodiment of the present invention.

FIG. 14 is a view similar to FIG. 2, but showing an engine unit 3' mounted on a small boat 1 with its cylinder axis L inclined to the right from the vertical.

A body 10 of the engine unit 3' is equipped with an electronically controlled fuel injection system in place of the diaphragm carburetor 82 and the induction box 83 shown in FIG. 2. The fuel injection system includes a throttle body 91, an acceleration pump 92, an injection valve 93 and a computer (not shown) for controlling operation of the fuel injection system. An intake manifold 81 is designed to curve along a wall of a narrow engine room 2*a* so that the throttle body 91 is disposed in a desired position.

Figure 15:
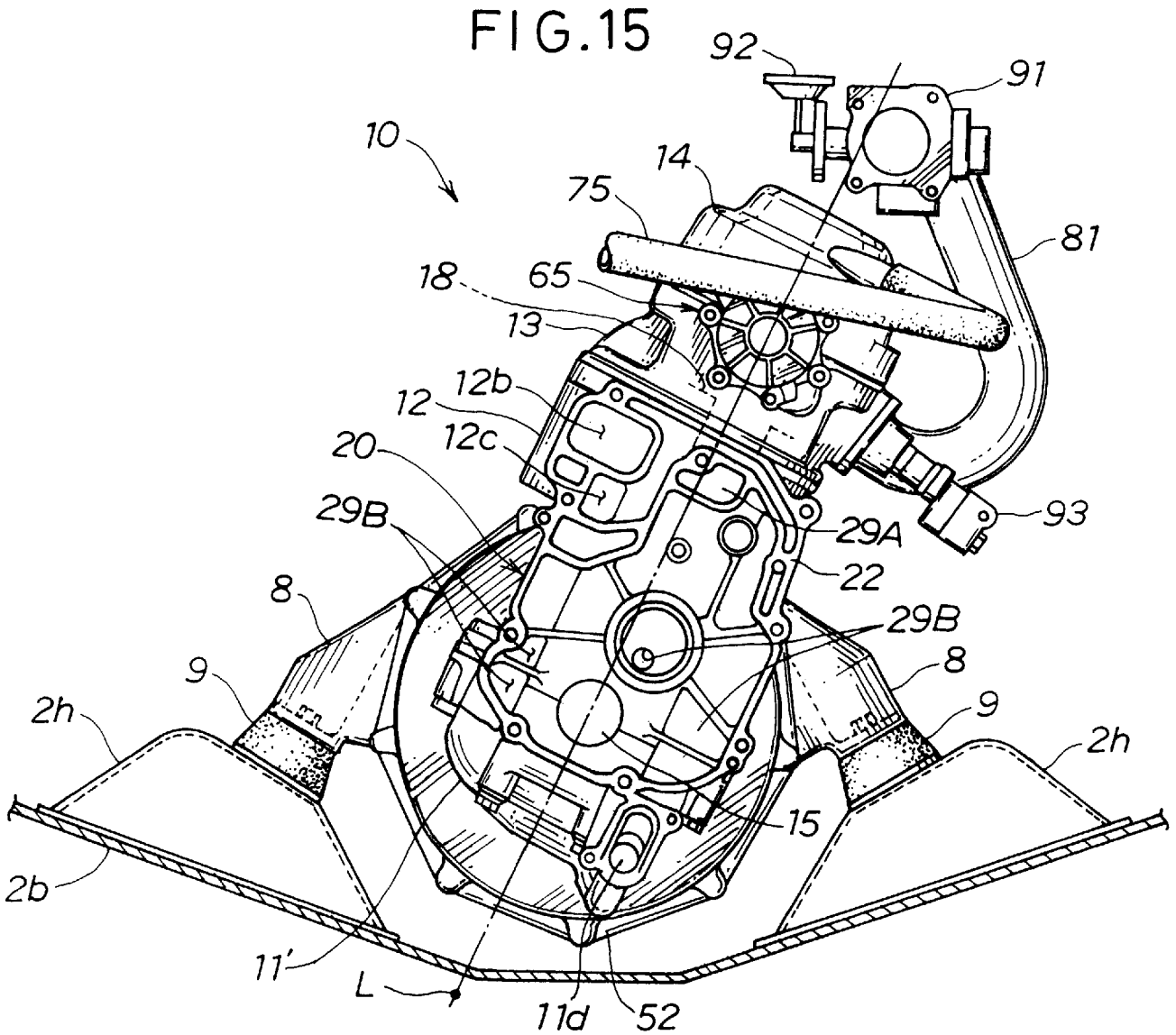
FIG. 15 is a rear elevational view of the engine shown with a lubricating oil tank removed therefrom.

FIG. 15 is a rear view of the engine body 10 shown with a lubricating oil tank 59' (FIG. 14) removed and a packing surface 22 of a cylinder-block-and-crankcase assembly 20 exposed to view.

As understood from comparison between FIG. 15 and FIG. 7, a cylinder block 12 of the engine body 10 shown in FIG. 15 is the same as the cylinder block 12 of the engine body 10 shown in FIG. 7. A crankcase 11' of the engine body 10 shown in FIG. 15 and the crankcase 11 of the engine body 10 shown in FIG. 7 are symmetrical with respect to the cylinder axis L. Thus, the same cylinder block 12 can be used regardless of the direction of inclination of the cylinder axis L. By virtue of the rightward inclination of the cylinder axis L shown in FIG. 15, the connecting passage 28 (see FIG. 4) extending between the valve chamber 18 and the crank chamber 19 inclines rightward and serves also as an oil return passage through which lubricating oil in the valve chamber 18 falls down into the crank chamber 19. Thus, the oil return tube 27 used in the first embodiment shown in FIG. 4 may be omitted.

Figure 16:
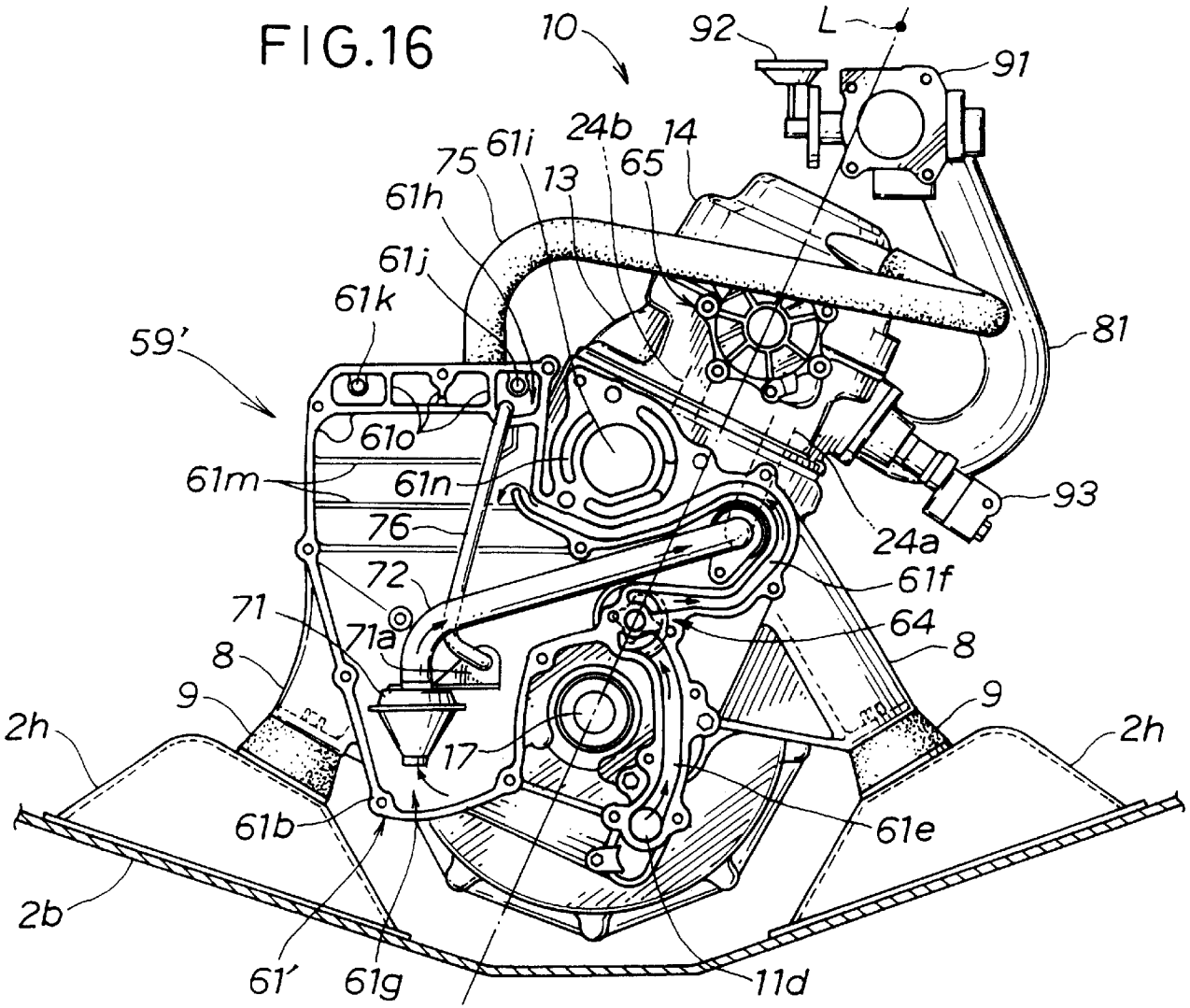
FIG. 16 is a view similar to FIG. 15, but showing the engine having the lubricating oil tank with an end cover removed therefrom.

FIG. 16 is a view similar to FIG. 14, but showing the engine body 10 with an end cover 63' of the lubricating oil tank 59' removed. The lubricating oil tank 59' has a bulged portion (not designated) extending along a side of the engine body 10. The bulged portion is disposed on the left side of the cylinder axis L which is opposite to the direction of inclination of the cylinder axis L. A design change from the engine unit 3 shown in FIGS. 7–9 to the engine unit 3' shown in FIGS. 14–16 can be accomplished at a relatively low cost because the same cylinder block 12 is used in common to both engine units 3, 3'. Replacement of the crankcase and lubricating oil tank, which may be achieved by modifications of molds, requires smaller cost than replacement of the cylinder block because the molds for the crankcase and lubricating oil tank are much smaller than a mold used for the production of the cylinder block.

The number of the cylinders of the engine unit 3, 3' should by no means be limited to three in the illustrated embodiment and four or more cylinders may be used. The lubricating oil tank 59, 59' should preferably mounted on a surface of the cylinder-block-and-crankcase assembly 20 which extends perpendicularly to the axis of the crankshaft 15. For example, the lubricating oil tank 59, 59' may be attached to the front end face of the engine body 10 in which instance the valve drive mechanism 40 and the flywheel unit 50 are mounted on the rear end face of the engine body 10 from which the power takeout shaft 17 projects. The lubricating oil tank 59, 59' thus mounted faces forward of the boat 1. One of the first and second breather passages 28 and 29A, 29B may be omitted.

As described above, the internal combustion engine with dry sump lubricating system according to the invention includes a lubricating oil tank attached to an end face of the engine body. The lubricating oil tank thus attached does not increase the overall width (a dimension in the direction perpendicular to the axis of the crankshaft) and height of the engine unit. Even when the engine has an inclined cylinder axis, the lubricating oil tank can avail a high degree of design freedom because the end face is not influenced as greatly as side surfaces of the engine body by inclination of the cylinders. Additionally, the same cylinder block can be used regardless of the direction of inclination of the cylinders.

When the engine is subjected to a postural change such as rolling through an angle of 180 degrees, lubricating oil in the lubricating oil tank flows into the valve chamber. In this instance, however, due to a vacuum formed in the lubricating oil tank with feed and recovery pumps being stopped, only a limited quantity of lubricating oil is permitted to flow into the valve chamber. In other words, to the passage which is formed jointly by the first breather tube and the lubricating oil tank is applied the principle of "Torricellian vacuum" which limits passage of the lubricating oil to a predetermined quantity. In this condition, the second opening is located at s higher level than the first opening, and so the lubricating in the valve chamber cannot flow into the first breather chamber through the second opening and thence to the intake line of the engine. Thus, even when the engine changes is subjected to postural changes, the lubricating oil in the breather is recovered with high efficiency. The first breather chamber and the second breather chamber are disposed below an upper end of the head cover, they do not increase the overall height of the engine.

The lubricating oil tank is composed of a tank body attached to the end face of the engine body and having an open end facing away from the end face, and an end cover removably attached to the tank body so as to close the open end of the tank body. By removing the end cover, the interior of the tank body can readily be inspected.

The lubricating system having a recovery pump built in the lubricating oil tank is simple in construction, small in size, easy to assemble and can be manufactured at a low cost. This poses a substantial reduction in manufacturing cost of the engine.

The baffle plate assembly composed of at least two, press-formed baffle plate pieces of identical configuration is smaller in size than a conventional press-formed elongated baffle plate and can be manufactured less costly than the conventional baffle plate because it requires a smaller press-forming mold than the conventional baffle plate. This is also contributive to reduction of the manufacturing cost of the engine.

Obviously, various minor changes and modifications of the present invention are possible in the light of the above teaching. It is to be understood that within the scope of the appended claims the present invention may be practiced otherwise than as specifically described.

What is claimed is:

1. An internal combustion engine having an intake system, comprising:

(a) an engine body including a crankshaft rotatably mounted therein with one end projecting from an end face of said engine body, a head cover at the top of said engine body and defining a valve chamber, and a crankcase at the bottom of said engine body and defining a crank chamber;

(b) a dry sump lubricating system for lubricating moving parts in said engine with a lubricating oil, said lubricating system including (i) an oil sump at the bottom of said crank chamber for temporarily holding therein the lubricating oil that has dripped from the moving parts down into said crank chamber, (ii) an oil tank attached to said end face of said engine body for holding therein the lubricating oil, (iii) a feed pump driven by said crankshaft for supplying the lubricating oil from said oil tank to the moving parts of said engine body, and (iv) a recovery pump driven by said crankshaft for sending the lubricating oil from said oil sump back into said oil tank; and (c) a breather system connecting said crank chamber and said oil tank to the intake system of the engine to circulate blowby gas and oil vapors from said crank chamber and said oil tank to the intake system.

2. An internal combustion engine according to claim 1, wherein said oil tank is disposed below said head cover, and said valve chamber has a first opening and a second opening disposed below said first opening, and wherein said breather system includes a breather passage extending between said crank chamber and said valve chamber to connect them in fluid communication with each other, a first breather tube extending between said oil tank and said first opening of said valve chamber to connect said oil tank and said valve chamber in fluid communication with each other, a first breather chamber disposed below an upper end of said head cover for separating liquid oil from the blowby gas and oil vapors, said first breather chamber being in fluid communication with said valve chamber via said second opening of said valve chamber, a second breather chamber disposed below said first breather chamber for further separating liquid oil from the blowby gas and oil vapors, a second breather tube extending between said first breather chamber and said second breather chamber to connect them in fluid communication with each other, and a third breather tube extending between said second breather chamber and the intake system of said engine.

3. An internal combustion engine according to claim 2, wherein said first and second breather chambers are disposed between said upper end of said head cover and a lower end of said crankcase.

4. An internal combustion engine according to claim 3, wherein said head cover has a portion projecting in said valve chamber and defining said first breather chamber, and said oil tank has an upper portion defining said second breather chamber.

5. An internal combustion engine according to claim 4, wherein said second breathing chamber has at least two partition walls having respective orifices offset from one another to define within said second breather chamber at least three breather compartments connected together via said orifices, one of two endmost breather compartments of said three breather compartments is connected to one end of said second breather tube, and the other of said two endmost breather compartments is connected to one end of said third breather tube.

6. An internal combustion engine according to claim 1, wherein said engine body further includes a camshaft rotatably disposed in said valve chamber and connected in driven relation to said crankshaft, said recovery pump is built in said oil tank, and said supply pump is connected in driven relation to said camshaft.

7. An internal combustion engine according to claim 6, said engine body further includes a power transmitting mechanism for transmitting rotational power of said crankshaft to said recovery pump to drive said recovery pump, wherein said end face of said engine body has a recessed portion extending around said crankshaft and receiving therein said power transmitting mechanism, said recessed portion being substantially closed by said oil tank.

8. An internal combustion engine according to claim 1, wherein said oil tank includes a tank body attached to said end face of said engine body and having an open end facing in a direction perpendicularly to and away from said end face of said engine body, and an end cover attached to said tank body so as to close said open end of said tank body.

9. An internal combustion engine according to claim 8, wherein said end face of said engine body is perpendicular to an axis of said crankshaft, said tank body has a first packing surface at an end opposite from said open end and a second packing surface at said open end, said first packing surface being in sealing contact with said end face of said engine body, and said second packing surface being parallel to said first packing surface, and said end cover has a cover packing surface being sealing contact with said second packing surface of said tack body.

10. An internal combustion engine according to claim 9, wherein said recovery pump is built in said oil tank, and at least one of said second packing surface and said cover packing surface has a first oil passage extending between said crank chamber and said recovery pump and a second oil passage extending from said recovery pump and opening to an internal space of said oil tank.

11. An internal combustion engine according to claim 1, wherein said oil tank has a bulged portion extending along a side of said engine body in a direction toward an opposite end of said crankshaft.

12. An internal combustion engine according to claim 11, wherein said bulged portion has a lower portion tapering toward a lower end of said oil tank.

13. An internal combustion engine according to claim 12, wherein said engine body further includes at least one cylinder having an axis inclined from a vertical plane in one direction, and said side of said engine body along which said bulged portion of said oil tank extends is located on a side of said vertical plane which is opposite to the direction of inclination of said axis of said cylinder.

14. An internal combustion engine according to claim 1, wherein said crankcase includes at least three bearing portions disposed at the bottom of said crank chamber and spaced at predetermined intervals in a longitudinal direction of said crankshaft for rotatably supporting said crankshaft, said oil sump of said lubricating system includes at least two oil sump portions defined between respective adjacent pairs of said bearing portions, and said lubricating system further includes at least two press-formed baffle plates of identical configuration attached to said crankcase so as to substantially close said oil sump portions to prevent the lubricating oil from splashing over said crankshaft.

15. An internal combustion engine according to claim 14, wherein said engine body further includes at least two cylinders having axes inclined from a vertical plane in one direction, and said lubricating system further has a guide passage extending at said bottom of said crank chamber in a longitudinal direction of said crankshaft and connecting one ends of said at least two oil sump portions, said guide passage being connected in fluid communication with said recovery pump and located on a side of said vertical plane which is the same as the direction of inclination of said axes of said cylinders.

* * * * *